US010538887B2

(12) United States Patent
Thrall et al.

(10) Patent No.: US 10,538,887 B2
(45) Date of Patent: Jan. 21, 2020

(54) ADJUSTABLE CONNECTION FOR STRUCTURAL MEMBERS

(71) Applicants: University of Notre Dame du Lac, South Bend, IN (US); HNTB Corporation, New York, NY (US)

(72) Inventors: Ashley P. Thrall, South Bend, IN (US); Mirela D. Tumbeva, Notre Dame, IN (US); Theodore P. Zoli, III, New York, NY (US)

(73) Assignees: University of Notre Dame du Lac, South Bend, IN (US); HNTB Corporation, New York, NY (US)

( * ) Notice: Subject to any disclaimer, the term of this patent is extended or adjusted under 35 U.S.C. 154(b) by 290 days.

(21) Appl. No.: 15/610,414

(22) Filed: May 31, 2017

(65) Prior Publication Data

US 2017/0268185 A1 Sep. 21, 2017

Related U.S. Application Data

(63) Continuation of application No. 15/292,801, filed on Oct. 13, 2016, now Pat. No. 10,190,271.

(60) Provisional application No. 62/343,152, filed on May 31, 2016, provisional application No. 62/286,678,
(Continued)

(51) Int. Cl.

| | |
|---|---|
| ***E01D 19/00*** | (2006.01) |
| ***E01D 6/00*** | (2006.01) |
| ***E01D 4/00*** | (2006.01) |
| ***E04C 3/08*** | (2006.01) |
| ***E04C 3/40*** | (2006.01) |

(Continued)

(52) U.S. Cl.
CPC ..... *E01D 6/00* (2013.01); *E01D 4/00* (2013.01); *E01D 15/133* (2013.01); *E04C 3/08* (2013.01); *E04C 3/40* (2013.01); *E04C 2003/0491* (2013.01)

(58) Field of Classification Search
CPC ... E01D 6/00; E01D 19/00; E04C 3/08; E04C 2003/0413; E04C 2003/0486; E04C 2003/0491
USPC ..... 14/5, 14
See application file for complete search history.

(56) References Cited

U.S. PATENT DOCUMENTS

| | | | |
|---|---|---|---|
| 2,334 | A | 11/1841 | Cottrell |
| 118,566 | A | 8/1871 | Weimer |
| 447,422 | A | 3/1891 | Zenke |

(Continued)

FOREIGN PATENT DOCUMENTS

| | | | |
|---|---|---|---|
| CN | 201891069 | U | 7/2011 |
| CN | 202248251 | U | 5/2012 |
| CN | 103103929 | A | 5/2013 |

*Primary Examiner* — Gary S Hartmann
(74) *Attorney, Agent, or Firm* — Greenberg Traurig, LLP

(57) ABSTRACT

An adjustable structural connection—a connection which can be adjusted to alter the location and angle of member attachment—transforms the traditional notion of connections as a static means of connecting members at specific angles to a dynamic means of assembling a variety of structurally efficient forms. The adjustable connection connects a diagonal member to a vertical or horizontal member using either curved plate mounted to both of the structural members or a temporarily rotatable link. The adjustable connection can be used in a kit-of-parts type system, using multiple versions of the adjustable connection, which can join members at a wide variety of angles using a small number of unique components.

10 Claims, 30 Drawing Sheets

Related U.S. Application Data filed on Jan. 25, 2016, provisional application No. 62/240,776, filed on Oct. 13, 2015.

(51) Int. Cl.
*E01D 15/133* (2006.01)
*E04C 3/04* (2006.01)

(56) References Cited

U.S. PATENT DOCUMENTS 779,298 A * 1/1905 Miller ..... E01D 6/00 14/4
779,370 A 1/1905 Miller
1,163,641 A 12/1915 Cummings
1,896,530 A * 2/1933 Trout ..... E21B 15/00 403/174
1,962,820 A 6/1934 Knight
2,024,001 A * 12/1935 Hamilton ..... E01D 6/00 14/14
2,353,039 A * 7/1944 Janiszewski ..... E04B 1/58 52/654.1
2,559,741 A 7/1951 Wachsmann
3,152,347 A 10/1964 Williams
4,089,148 A 5/1978 Oehmsen
4,156,433 A 5/1979 Beaulieu
4,179,860 A 12/1979 Reale
4,551,957 A 11/1985 Madray
4,628,560 A 12/1986 Clevett et al.
4,706,436 A 11/1987 Mabey
4,829,736 A * 5/1989 Burger ..... B25J 18/025 52/650.1
4,957,186 A 9/1990 Reetz
5,024,031 A 6/1991 Hoberman
5,724,691 A 3/1998 Wiedeck
5,806,265 A * 9/1998 Sluiter ..... E04B 1/58 52/643
6,499,266 B1 * 12/2002 Macumber ..... E04C 3/08 52/632
6,516,583 B1 * 2/2003 Houghton ..... E04B 1/24 52/167.3
6,553,698 B1 4/2003 Kemeny
8,800,239 B2 8/2014 Yang
9,856,640 B2 * 1/2018 Shuhaibar ..... E04B 1/24
10,011,961 B2 7/2018 Bouleau
10,294,657 B2 * 5/2019 Shuhaibar ..... E04B 1/24

* cited by examiner

| $\theta_3$ | 30 | | 40 | 50 | 60 | 70 |
|---|---|---|---|---|---|---|
| $\alpha_{max}$ | 1.154700538 | | 1.30540729 | 1.55572383 | 2 | 2.9238044 |
| | $\alpha$ | $\theta_4$ | $\theta_4$ | $\theta_4$ | $\theta_4$ | $\theta_4$ |
| | 0.1 | 85.031816 | 85.606585 | 86.314557 | 87.134016 | 88.039987 |
| | 0.2 | 80.025778 | 81.187068 | 82.613755 | 84.260830 | 86.077675 |
| | 0.3 | 74.941353 | 76.713918 | 78.881647 | 81.373073 | 84.110742 |
| | 0.4 | 69.732099 | 72.156519 | 75.101052 | 78.463041 | 82.136816 |
| | 0.5 | 64.341094 | 67.478988 | 71.252763 | 75.522488 | 80.153448 |
| | 0.6 | 58.693554 | 62.636980 | 67.314500 | 72.542397 | 78.158085 |
| | 0.7 | 52.683476 | 57.572559 | 63.259439 | 69.512685 | 76.148037 |
| | 0.8 | 46.146221 | 52.205184 | 59.053993 | 66.421822 | 74.120439 |
| | 0.85 | 42.597926 | 49.372560 | 56.881702 | 64.849337 | 73.099106 |
| | 0.9 | 38.792236 | 46.414204 | 54.654269 | 63.256316 | 72.072210 |
| | 0.95 | 34.641573 | 43.302551 | 52.363611 | 61.640650 | 71.039324 |
| | 1.0 | 30.000000 | 40.000000 | 50.000000 | 60.000000 | 70.000000 |
| | 1.05 | 24.587532 | 36.452794 | 47.551519 | 58.331757 | 68.953767 |
| | 1.1 | 17.706319 | 32.579098 | 45.003274 | 56.632987 | 67.900130 |
| | 1.2 | | 23.182833 | 39.525165 | 53.130102 | 65.768517 |
| | 1.3 | | 5.216803 | 33.319142 | 49.458398 | 63.600575 |
| | 1.4 | | | 25.854726 | 45.572996 | 61.391102 |
| | 1.5 | | | 15.381432 | 41.409622 | 59.134118 |
| | 1.6 | | | | 36.869898 | 56.822661 |
| | 1.7 | | | | 31.788331 | 54.448517 |
| | 1.8 | | | | 25.841933 | 52.001834 |
| | 1.9 | | | | 18.194872 | 49.470591 |
| | 2 | | | | | 46.839822 |
| | 2.1 | | | | | 44.090448 |
| | 2.2 | | | | | 41.197442 |
| | 2.3 | | | | | 38.126799 |
| | 2.4 | | | | | 34.830193 |
| | 2.5 | | | | | 31.234701 |
| | 2.6 | | | | | 27.220550 |
| | 2.7 | | | | | 22.563568 |
| | 2.8 | | | | | 16.733085 |
| | 2.9 | | | | | 7.316227 |

FIG. 7

ADJUSTABLE CONNECTION FOR STRUCTURAL MEMBERS

CROSS REFERENCE TO RELATED APPLICATION

This application is a non-provisional application claiming priority from U.S. Provisional Application Ser. No. 62/343,185 filed May 31, 2016, entitled "Adjustable Connection For Structural Members" and is a continuation of U.S. Non-Provisional patent application Ser. No. 15/292,801 filed Oct. 13, 2016 entitled "Adjustable Modules for Variable Depth Structures" which in turns claims priority from U.S. Provisional Application Ser. No. 62/240,776 filed Oct. 13, 2015, entitled "Adjustable Module and Structure" and Ser. No. 62/286,678, filed Jan. 25, 2016, entitled "Adjustable Module for Variable Depth Arch Bridges." All of which are incorporated herein by reference in their entirety.

GOVERNMENT LICENSE RIGHTS

This invention was made with government support under CMMI-1351272 awarded by the National Science Foundation. The government has certain rights in the invention.

FIELD OF THE DISCLOSURE

The present description relates generally to a unique approach for joining structural members at a range of angles. This approach can be implemented for any joint between angled structural members. Applications include, but are not limited to, buildings (e.g., apex connections of portal frames) and bridges (e.g., angled connections of arch and truss bridges) for temporary or permanent construction.

BACKGROUND OF RELATED ART

In architecture, structural engineering, and construction, connections between structural members are typically individually designed for each joint in each structure. A variety of means are known in the art for affixing structural members together, including bolts, rivets, and welds, sometimes also incorporating plates.

In these methods, there is significant inefficiency in design, fabrication, and erection as each connection can be different in a structure and each structure is typically designed as one-of-a-kind. Alternatively, there can be major gains in efficiency and economy by using prefabricated connections that can join members at different angles in a wide variety of structures. Accordingly, there is a demonstrated need for an improved connection as declared herein.

BRIEF DESCRIPTION OF THE DRAWINGS

FIG. 7 is a table of $\theta_4$ for different values of $\theta_3$ and $\alpha$.

DETAILED DESCRIPTION

Figure 1A:
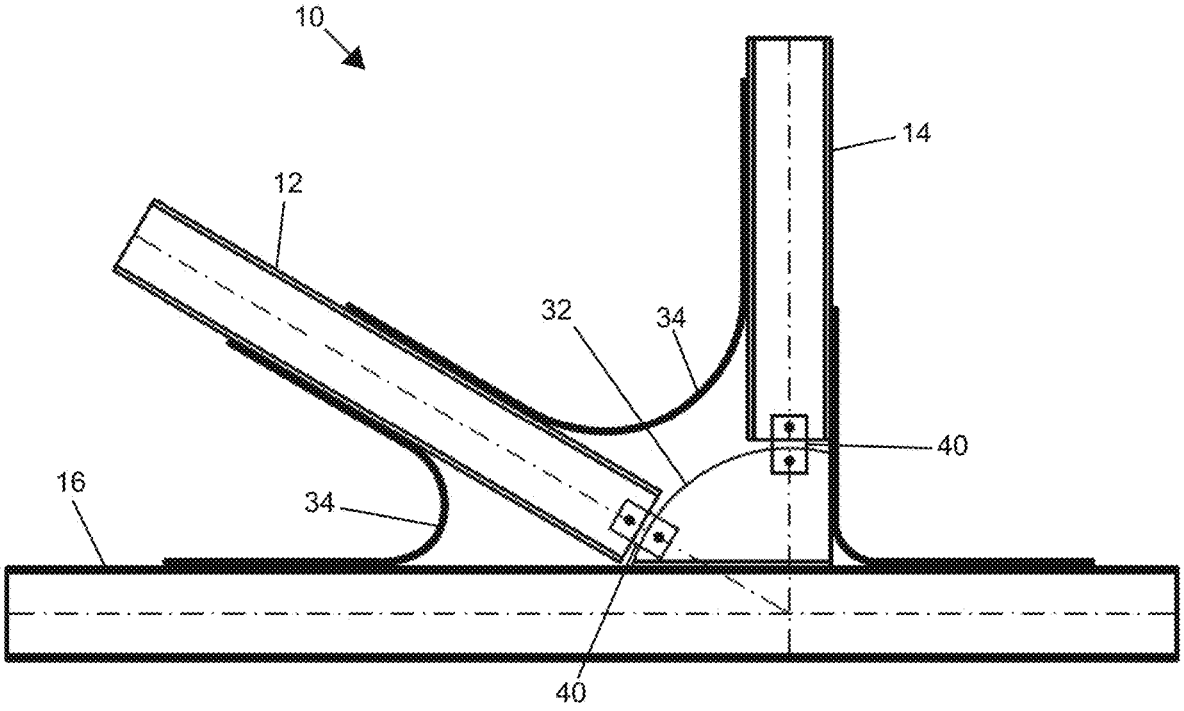
FIG. 1A is an example adjustable connection according to the teachings of this disclosure at 30° from the horizontal.
Figure 1B:
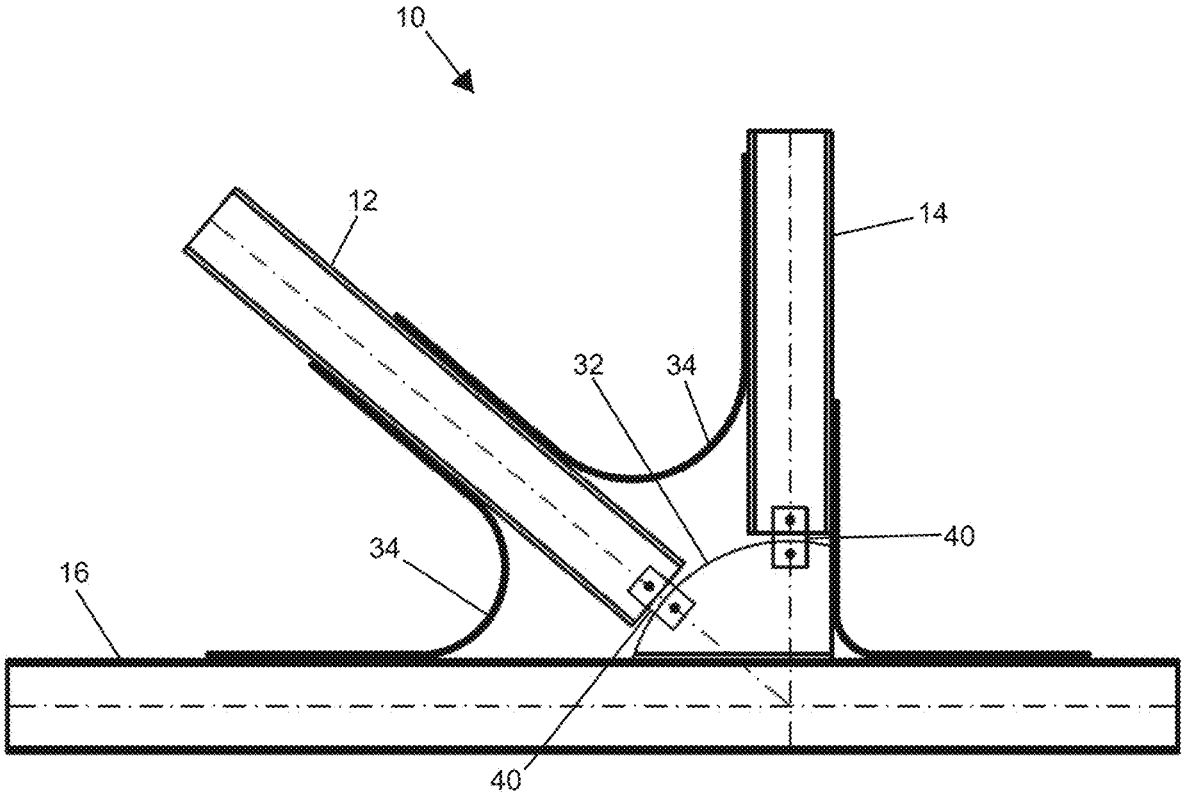
FIG. 1B is an example adjustable connection according to the teachings of this disclosure at 40° from the horizontal.
Figure 1C:
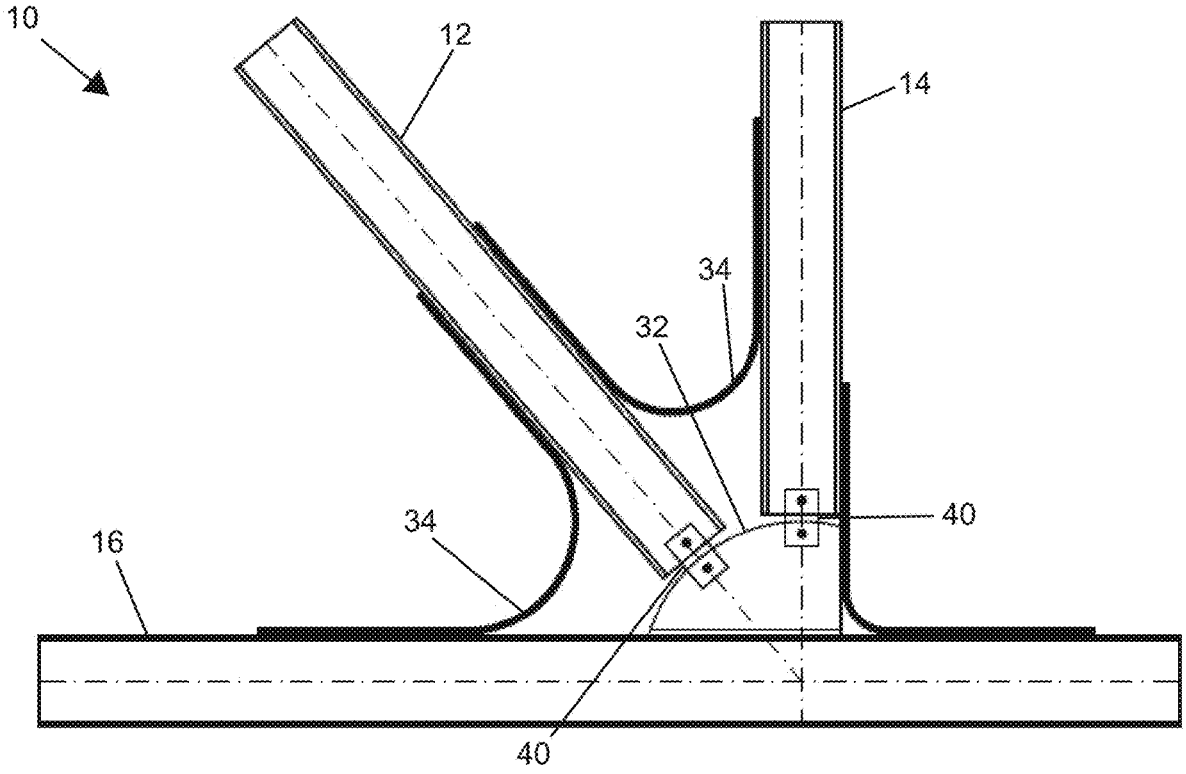
FIG. 1C is an example adjustable connection according to the teachings of this disclosure at 50° from the horizontal.

The following description of example methods and apparatus is not intended to limit the scope of the description to the precise form or forms detailed herein. Instead the following description is intended to be illustrative so that others may follow its teachings.

In the following description, the term "kit-of-parts" is used. One of ordinary in the art skill will appreciate in context that this is used to mean that the adjustable connection herein disclosed could be used with a combination of other like adjustable connections adapted for different angle ranges and scales of the structural members.

The goal of the adjustable connection as disclosed is to join 2 or more structural members at a variety of angles using a small number of unique components. This facilitates the joining of members to form varying geometric structures using the same adjustable connection. Such adjustable connections can be used for many different joints in a one-of-a-kind type structures and/or connecting modules in a modular structure.

The adjustable connection as disclosed offers significant design, construction and fabrication advantages. Design can be simplified as the same adjustable connection could be used for one or more joints in a structure. The adjustable connection can be prefabricated and mass-produced, thereby simplifying fabrication. Construction could be accelerated as the connection can be repeated in the same structure and is capable of joining standard sections together.

This adjustable connection could apply to a wide variety of materials (e.g., steel, aluminum, advanced composites, wood). Applications include, but are not limited to, conventional structural design and construction (e.g., bridges, buildings), modular construction (e.g., panelized rapidly erectable bridges), or special structures (e.g., grid shells).

An example adjustable connection for joining structural members is comprised of one or more cold bent plates with specific bend angles and curvature and a universal gusset plate. Turning to FIG. 1A-H, an example adjustable connection 10 joins three structural members, including a diagonal structural member 12 to be joined to a first vertical structural member 14 and a second horizontal structural member 16. In an example adjustable connection in FIG. 1, the diagonal structural member 12 will be positioned at a desired angle relative to the first vertical structural member 14 and second horizontal structural member 16 using the adjustable connection 10. For any given angle, the diagonal member 12 is connected to the horizontal member 16 and the vertical member 14 by two curved plates 34 and the one universal gusset plate 32. The vertical member 14 could also be directly connected to the horizontal member 16, using the one universal gusset plate 32 or other means. A set of curved plates 34 can be prefabricated to serve different angles. An advantage of this connection is that the centerlines of all three members are intersecting at one point (O), thereby eliminating eccentric loading and additional bending.

Figure 1D:
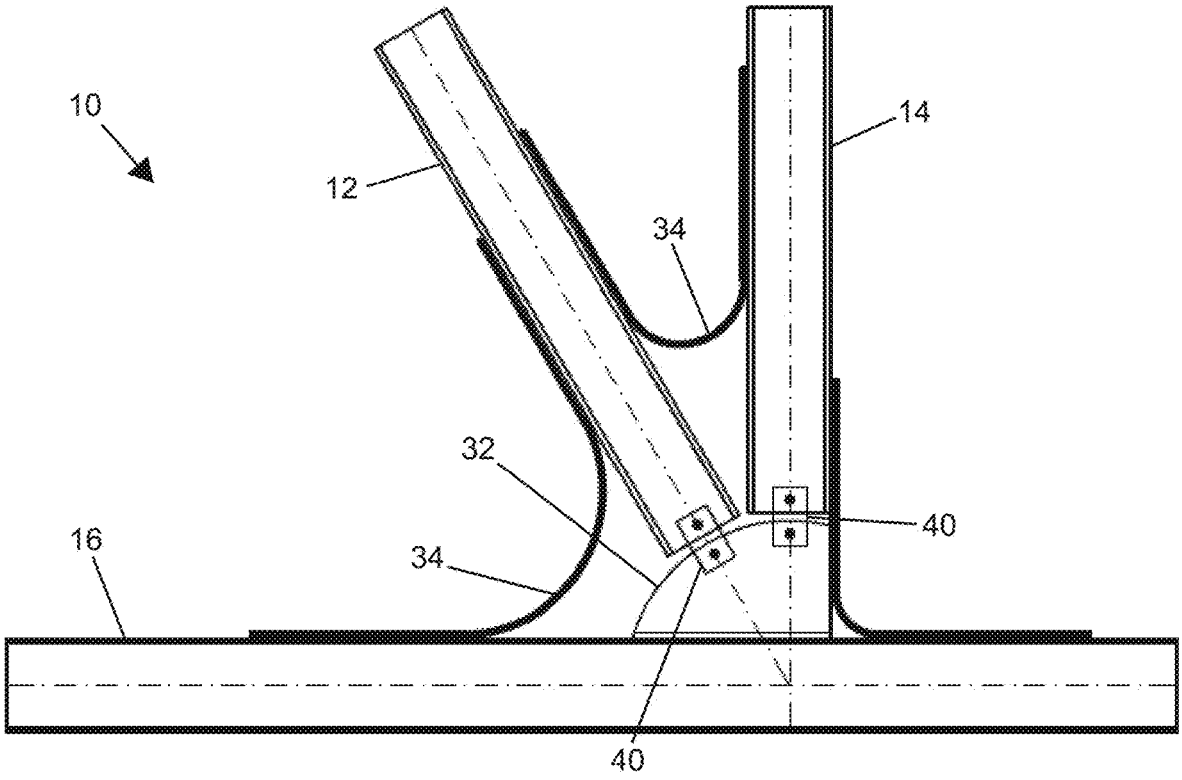
FIG. 1D is an example adjustable connection according to the teachings of this disclosure at 60° from the horizontal.
Figure 1E:
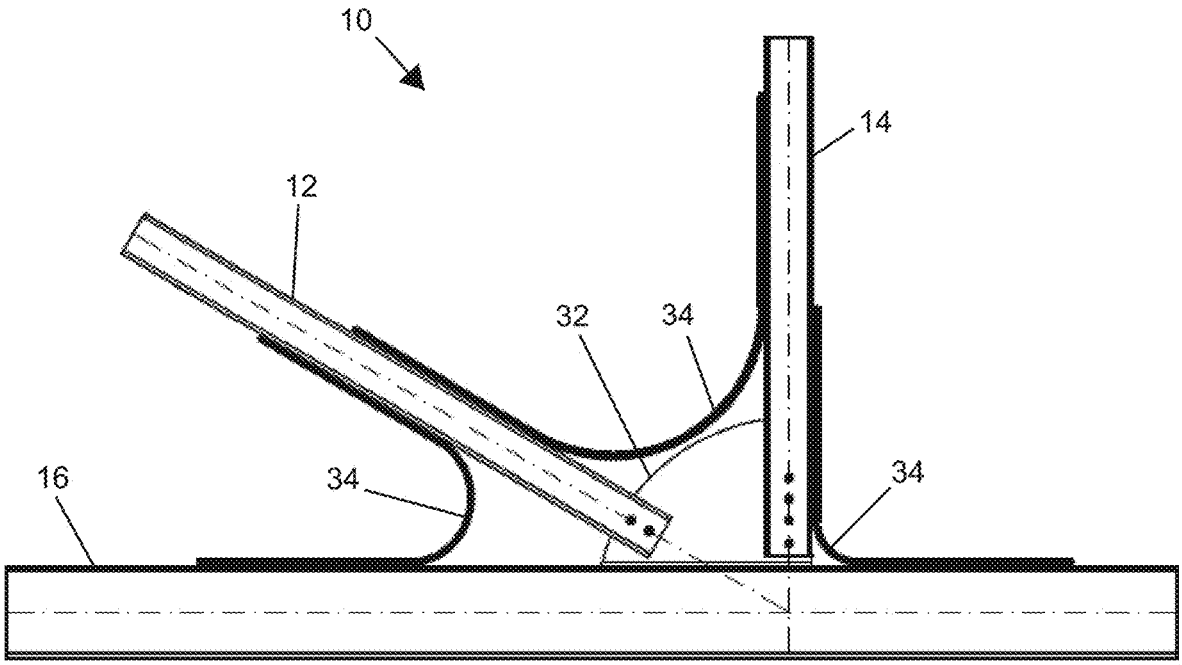
FIG. 1E is an example adjustable connection according to the teachings of this disclosure at 30° from the horizontal.
Figure 1F:
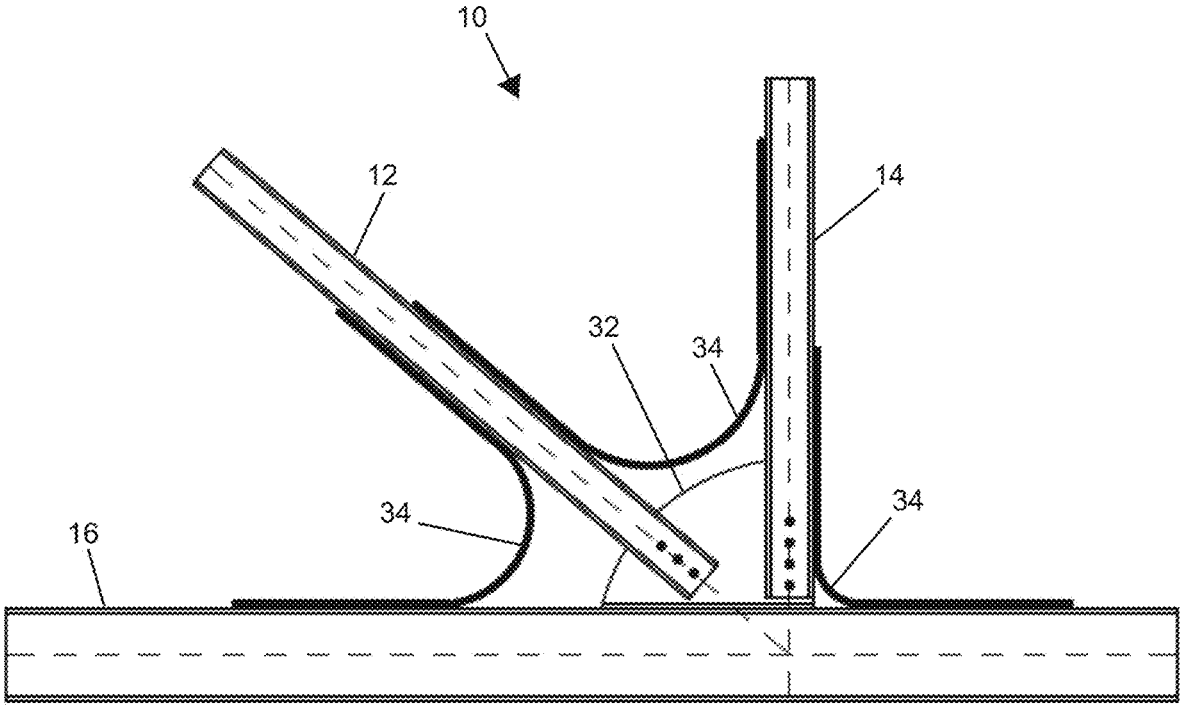
FIG. 1F is an example adjustable connection according to the teachings of this disclosure at 40° from the horizontal.
Figure 1G:
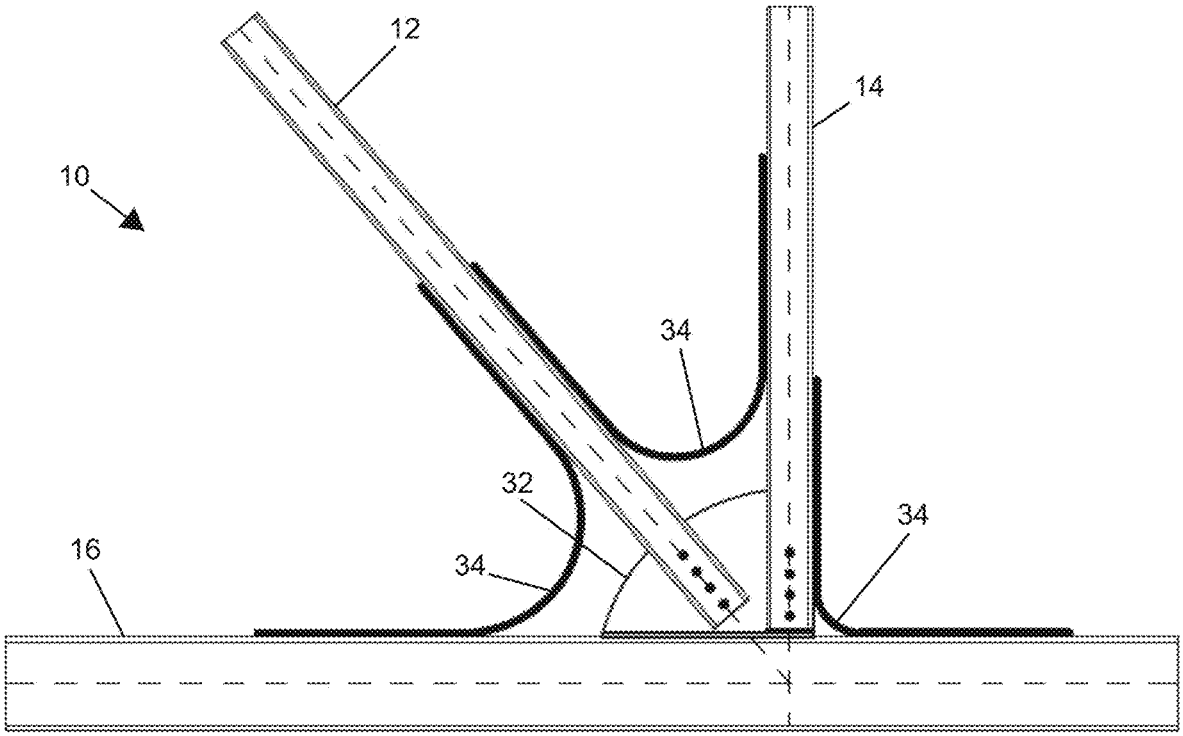
FIG. 1G is an example adjustable connection according to the teachings of this disclosure at 50° from the horizontal.
Figure 1H:
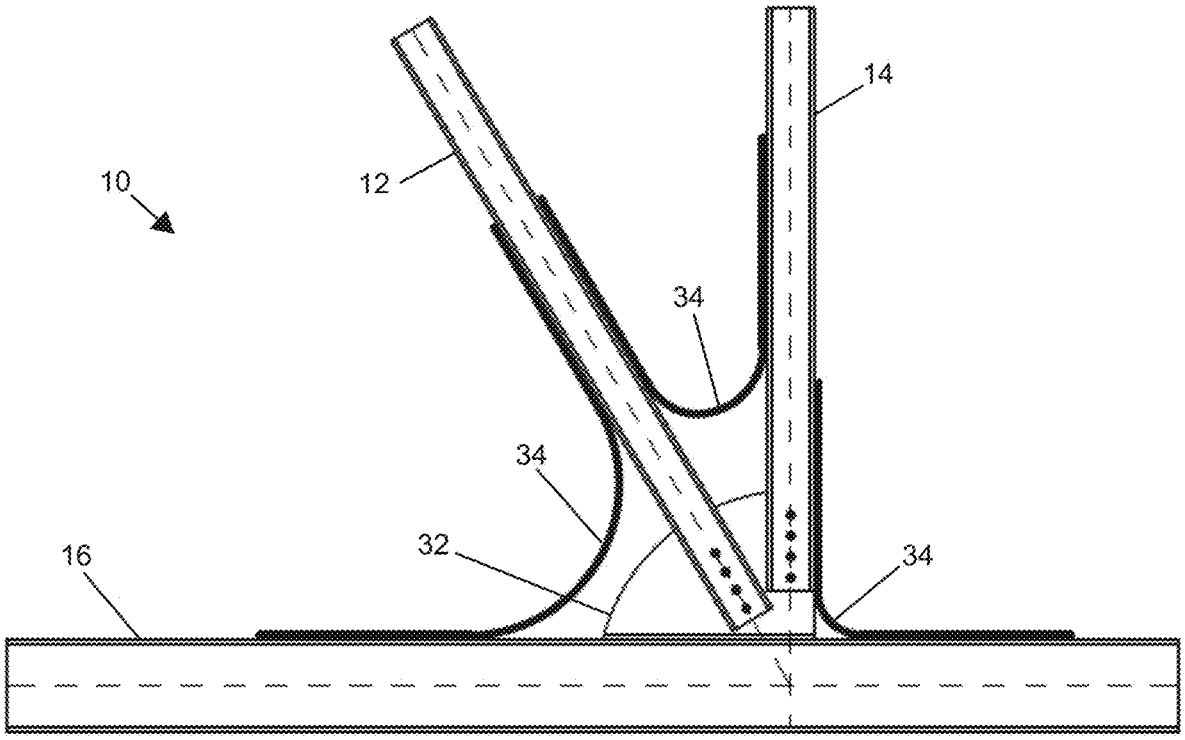
FIG. 1H is an example adjustable connection according to the teachings of this disclosure at 60° from the horizontal.

In the example adjustable connection in FIG. 1A-H, structural members can be joined at angles θ. This disclosure shows example adjustable connections 10 with angles θ=30°, 40°, 50°, and 60°, but other angles could be considered. FIG. 1A joins the diagonal member 12 to the vertical member 14 and the horizontal member 16 at an angle of θ=−30°, measured relative to the horizontal member 16. FIG. 1D joins the diagonal member 12 to the vertical member 14 and the horizontal member 16 at an angle of θ=60°, measured relative to the horizontal member 16. The same set of curved or bent plates can be used to achieve both angles. More specifically, the bent plate 34 joining the horizontal member 16 and the diagonal member 12 shown in FIG. 1A can be used to join the vertical member 14 and the diagonal member 12 shown in FIG. 1D. Similarly, the bent plate 34 joining the vertical member 14 and the diagonal member 12 shown in FIG. 1A can be used to join the in horizontal member 16 and the diagonal member 12 shown in FIG. 1D. This same approach is used to achieve the example embodiment shown in FIG. 1B and FIG. 1C, where the example embodiment in FIG. 1B joins the diagonal member 12 to the vertical member 14 and the horizontal member 16 at an angle of θ=40°, measured relative to the horizontal member 16 and the example embodiment in FIG. 1C joins the diagonal member 12 to the vertical member 14 and the horizontal member 16 at an angle of θ=50°, measured relative to the horizontal member 16.

While FIG. 1 shows a connection between three structural members, the adjustable connection 10 could join 2 or more structural members. In the example adjustable connection 10 shown in FIG. 1A-D, the diagonal, horizontal, and vertical members, 12, 16, and 14, respectively, are shown as wide flange (I-shaped) members. The diagonal and vertical members, 12 and 14, respectively, are connected to the universal gusset plate 32 by plates 40.

In the example adjustable connection 10 shown in FIG. 1E-H, the diagonal and vertical members, 12 and 14, respectively, are shown as two back-to-back channel sections. In this case, plates are not needed to connect the diagonal and vertical members, 12 and 14, respectively, to the universal gusset plate 32 as the sections could connect directly to the universal gusset plate 32 in double shear. The horizontal member 16 could be either a wide flange or back-to-back channel section, or other section.

In the example embodiment in FIG. 1, the cold bent curved plates 34 are connected to the flanges of the members. This creates a moment-resisting joint between members that can be achieved through splice-type connections using bolts. This provides a stronger, more durable, and reliable connection between structural members as compared to a typical gusset plate connection.

In the example embodiment in FIG. 1, the shape and size of the gusset plate 32 depends on the cross section of the various members and on where the diagonal 12 intersects with the vertical and horizontal members 14 and 16, respectively. It is not necessarily drawn to scale in FIG. 1. Its size should be limited to avoid buckling. In the example embodiment in FIG. 1, the gusset plate 32 features a flange which is connected to the horizontal member 16 and a web which joins diagonal member 12 and vertical member 14.

Figure 2:
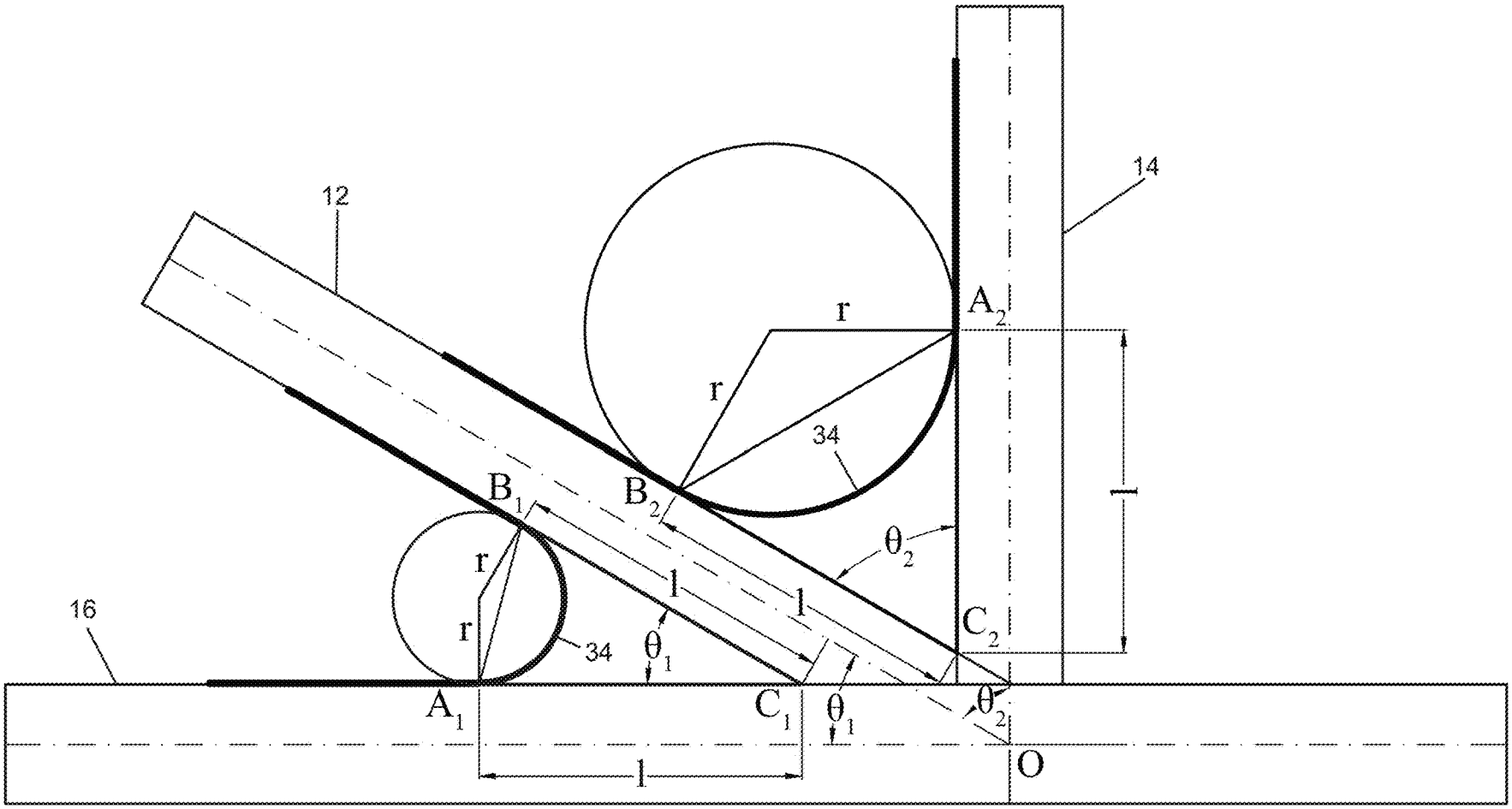
FIG. 2 is a depiction of the geometric scribing for the adjustable connection.

As shown in FIG. 2, a linkage (i.e., an assembly of rigid structural members connected by joints) can be used to scribe the geometry for the adjustable connection. This concept is demonstrated here for an RRRP linkage (where R refers to revolute joints and P refers to prismatic joints) connecting a horizontal, vertical, and diagonal member, 16, 14, and 12, respectively. In FIG. 2, the linkage includes a first rigid link of length (l) connecting points A and C. A revolute joint at C, connects this first rigid link to a second rigid link of length (l) connecting points C and B. Another revolute joint is located at point B. This is then connected to slider AB. This is shown for the connection between the diagonal member 12 and horizontal member 16 with the subscript 1. It is shown for the connection between the diagonal member 12 and the vertical member 14 with the subscript 2. Note that many different linkages could be used, and this concept could be applied to many different types of structural forms. While this example uses geometry related to a linkage, the geometry of the adjustable connection 10 can be developed without any relationship to a linkage.

In the RRRP linkage as shown in FIG. 2, the link length (l) is the same for link AC and CB. It is beneficial to have this constant distance (l) along which the members are connected by curved plates 34 for all angles. This minimizes the number of different connection locations (i.e., bolt holes) along the various structural members to achieve different angles, thereby facilitating prefabrication and erection of the members.

As implemented in FIG. 3, detailed geometry related to this linkage is discussed below. The rigid links (l) are tangent lines to a circle with radius (r)—where r is the bend radius of the plates—at points A and B. The conceptual slider AB connects points A and B and is a chord of this circle. The length (l) and the radius (r) are related by:

$$l = \frac{r}{\tan(\theta/2)} \quad \text{eq. (1)}$$

The same link length (l) is used for both the connection of the diagonal 12 to the horizontal 16 and the diagonal 12 to the vertical 14. Several angles are considered for the purpose of this disclosure: θ=30°, 40°, 50°, 60° as shown in the example embodiment in FIG. 1. If the length of the links (l) and the angle (θ) are known, then the position of the plates can be determined.

Figure 3:
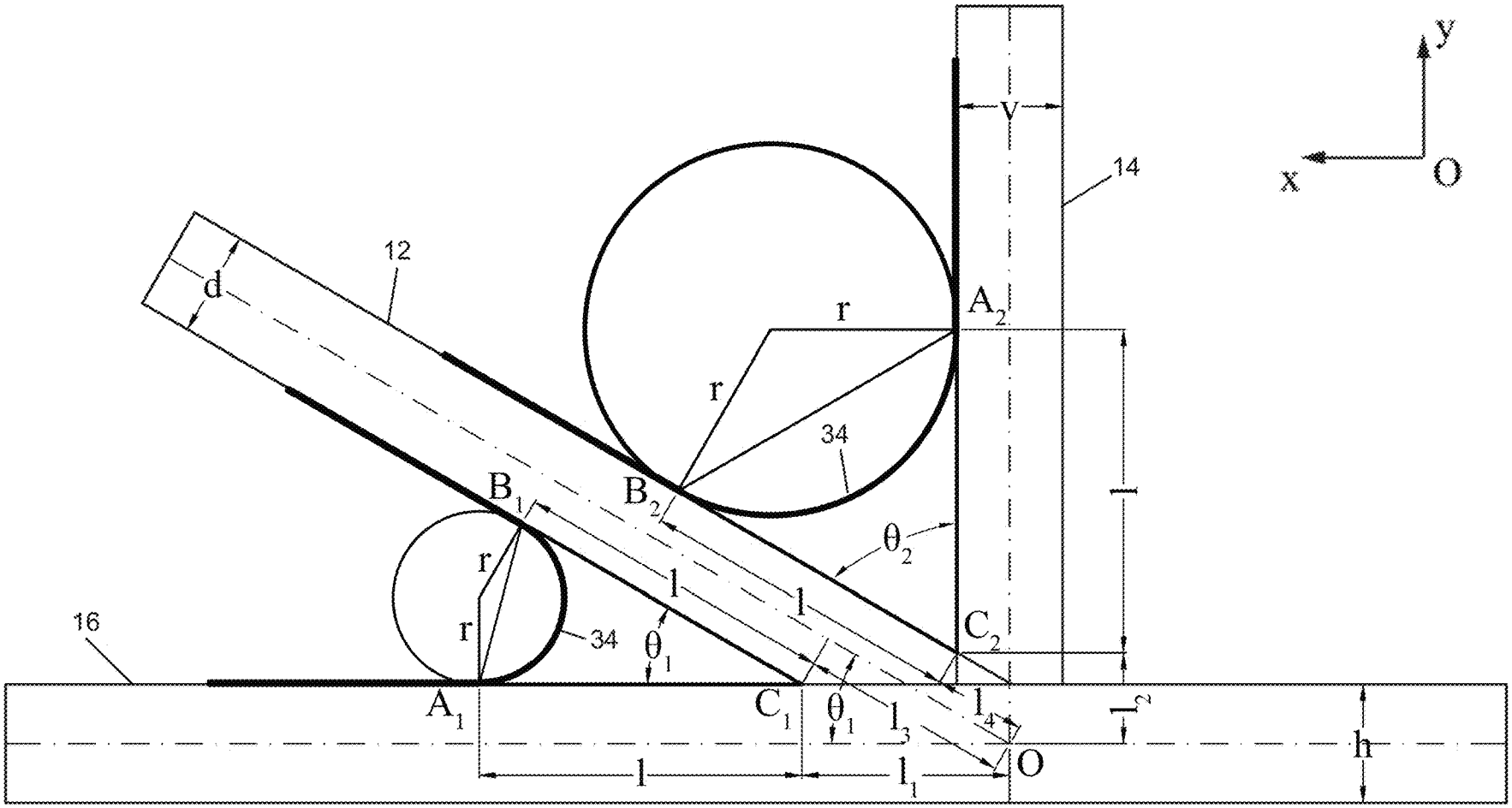
FIG. 3 is a depiction of the example adjustable connection using the scribing method shown in FIG. 2.

The location of the plates 34 relative to the origin (O) is now defined as shown in FIG. 3. The X and Y coordinates of points $A_1$ and $B_1$ on the horizontal member 16 and diagonal member 12, respectively, can be determined by:

$$X_{A1} = l + l_1 \quad Y_{A1} = \frac{h}{2} \quad \text{eq. (2)}$$

and $$X_{B1} = l\cos\theta + l_1 \quad Y_{B1} = l\sin\theta + \frac{h}{2} \quad \text{eq. (3)}$$

where $l_1$ is the horizontal distance from the origin (O) to the location where the linkage begins in FIG. 3, and it is given by:

$$l_1 = \frac{d}{2\sin\theta} + \frac{h}{2\tan\theta} \quad \text{eq. (4)}$$

where, d is the depth of the diagonal member 12 and h is the depth of the horizontal member 16. The X and Y coordinates of $A_2$ and $B_2$ on the vertical members 14 and diagonal member 12, respectively, can be determined by:

$$X_{A2} = \frac{v}{2} \quad Y_{A2} = l + l_2 \quad \text{eq. (5)}$$

and $$X_{B2} = l\cos\theta + \frac{v}{2} \quad Y_{B2} = l\sin\theta + l_2 \quad \text{eq. (6)}$$

where $l_2$ is the vertical distance from the origin (O) to the location where the linkage begins in FIG. 3, and it is given by:

$$l_2 = \frac{v}{2}\tan\theta + \frac{d}{2\cos\theta} \quad \text{eq. (7)}$$

where v is the depth of the vertical member 14.

As identified in FIG. 2, the distance from the origin (O) to the point where the diagonal crosses the horizontal, measured along the centerline of the diagonal is defined as $l_3$ and is given by:

$$l_3 = \frac{d}{2\tan\theta} + \frac{h}{2\sin\theta} \quad \text{eq. (8)}$$

Following the same idea, the distance from the origin to the intersection point of the diagonal and the vertical is defined as $l_4$, shown in FIG. 2, and is given by:

$$l_4 = \frac{d}{2}\tan\theta + \frac{v}{2\cos\theta} \quad \text{eq. (9)}$$

To avoid buckling, it is recommended that the size of the universal gusset plate 32 in FIG. 1A-H and the plates in FIG. 1A-D be as small as possible to achieve the desired geometry.

Another embodiment of this disclosure is shown in FIGS. 4-12 showing an articulated linkages approach in which another example adjustable connection 10' is comprised of a linkage which alters the location and angle of the structural joint. During erection, the connection as a whole would remain a mechanism. When the desired position is achieved, the linkage would be fixed or locked into place. A wide variety of types and forms of linkages could be used for this embodiment of an adjustable connection.

Figure 4:
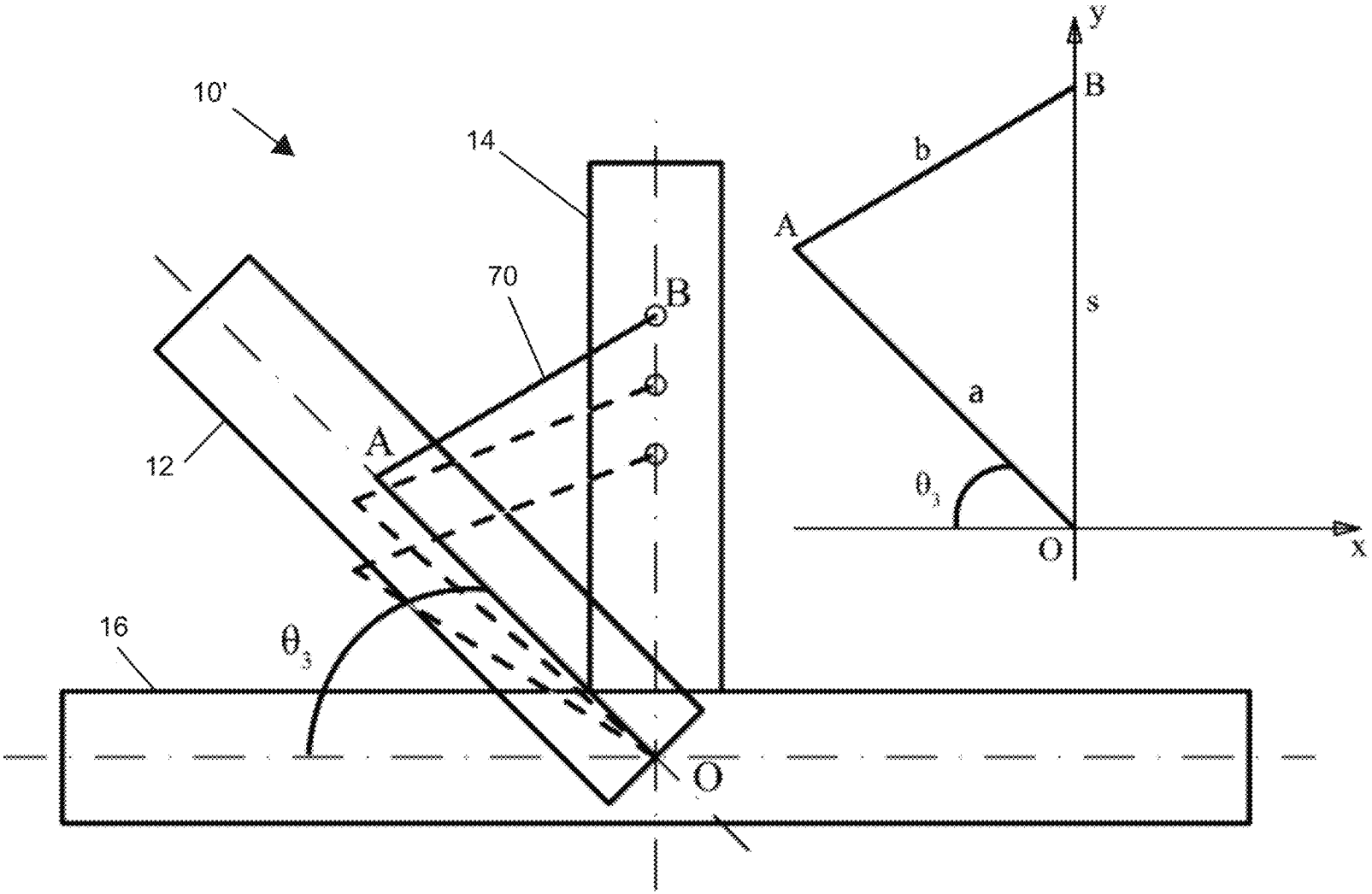
FIG. 4 is a depiction of a mechanism based adjustable connection according to the teachings of this disclosure applied to a joint between a diagonal and a vertical member.

As shown in FIG. 4, another example embodiment of the adjustable connection 10' joins a diagonal structural member 12 at an angle to both the vertical and horizontal members 14, 16. This angle $\theta_3$ is measured relative to the horizontal member 16 in FIG. 4. The diagonal structural member 12 is connected by a link 70 to the vertical member 14 in the example shown in FIG. 4. In the example shown, O is the point where the centerlines of the vertical member 14, the horizontal member 16, and the diagonal member 12 coincide. The diagonal member 12 would be rotatably connected to the vertical member 14 and the horizontal member 16 at point O. A is the point at which link 70 and diagonal member 12 meet. B is the point at which the link 70 meets the vertical member 14. The connection points at O, A, and B shown in FIG. 4 are initially rotatable joints, such as pin joints, allowing substantially free rotational motion. This motion allows the adjustable connection 10' to become a functional linkage and be positioned into the correct angle desired by the user (angle $\theta_3$). When the angle $\theta_3$ is achieved, the connections of the link 70 and diagonal member 12 are made static or locked into place by adding bolts, welding, or any other suitable means of securing members as would be understood by one of ordinary skill in the art. It is also contemplated that this static connection could be lockable and use a secure but removable mechanism.

Figure 5:
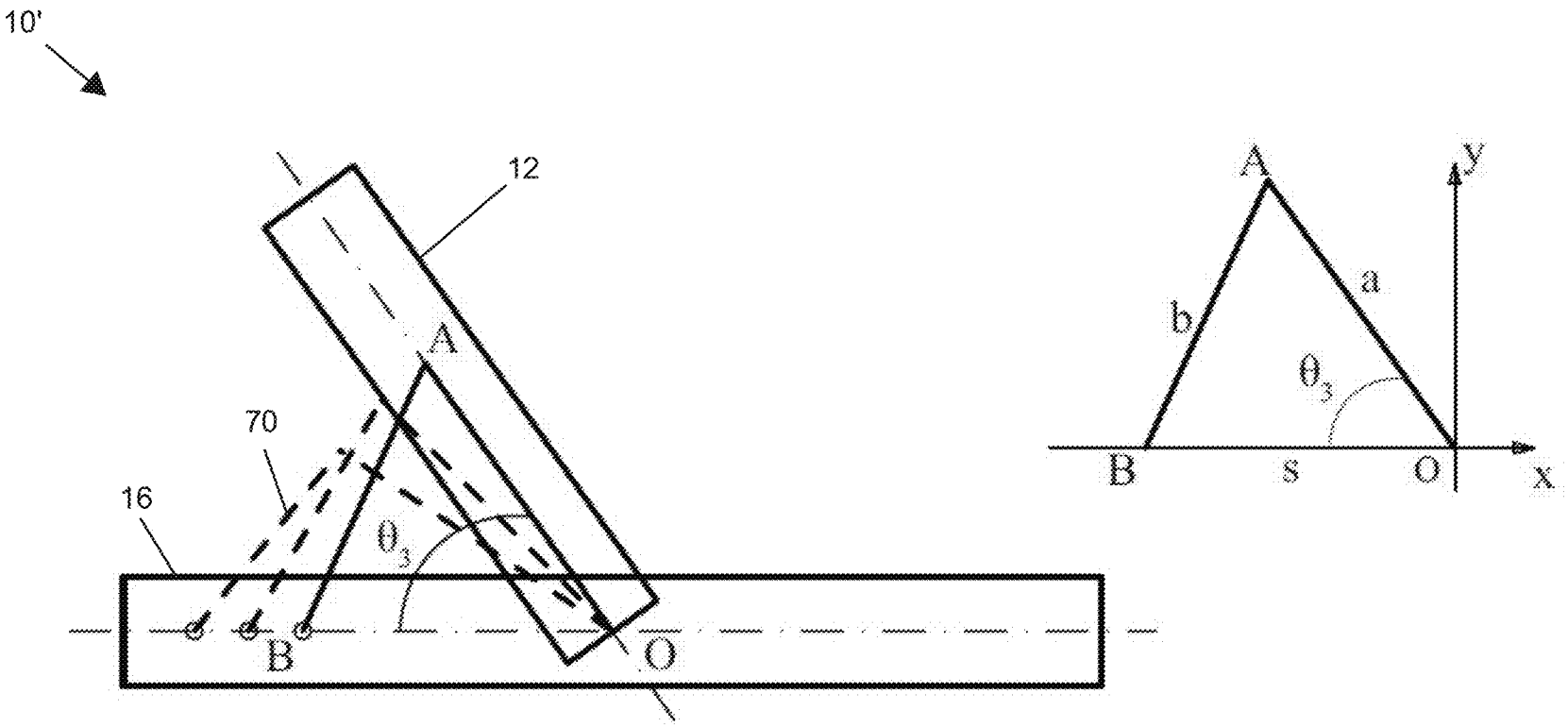
FIG. 5 is a depiction of a mechanism based adjustable connection according to the teachings of this disclosure applied to a joint between diagonal and horizontal member.

As shown in FIG. 5, another example embodiment of the adjustable connection 10' joins a diagonal structural member 12 and horizontal member 16 at an angle to the horizontal member 16. This angle $\theta_3$ is measured relative to the horizontal member 16 in FIG. 5. The diagonal structural member 12 is connected by a link 70 to the horizontal member 16 in the example shown in FIG. 5. In the example shown, O is the point where the centerlines of the horizontal member 16 and the diagonal member 12 coincide. The diagonal member 12 would be rotatably connected to the horizontal member 16 at point O. A is the point at which link 70 and diagonal member 12 meet. B is the point at which the link 70 meets the horizontal member 16. The connection points at O, A, and B shown in FIG. 4 are initially rotatable joints, such as pin joints, allowing substantially free rotational motion. This motion allows the adjustable connection 10' to become a functional linkage and be positioned into the correct angle desired by the user (angle $\theta_3$). When the angle $\theta_3$ is achieved, the connections of the link 70 and diagonal member 12 are made static or locked into place by adding bolts, welding, or any other suitable means of securing members as would be understood by one of ordinary skill in the art. It is also contemplated that this static connection could be lockable and use a secure but removable mechanism.

The concept is demonstrated here using geometry scribed by an RRRP linkage (where R refers to revolute joints and P refers to prismatic joints). The RRRP linkage is considered for two orientations: Vertical RRRP in FIG. 4 (joining three structural members) and Horizontal RRRP in FIG. 5 (joining two structural members). Only the Vertical RRRP configuration is discussed in detail here, but analogous procedures and equations could be used for the Horizontal RRRP configuration. The objective is to create a joint which can connect variable angle diagonal truss members 12.

Figure 6:
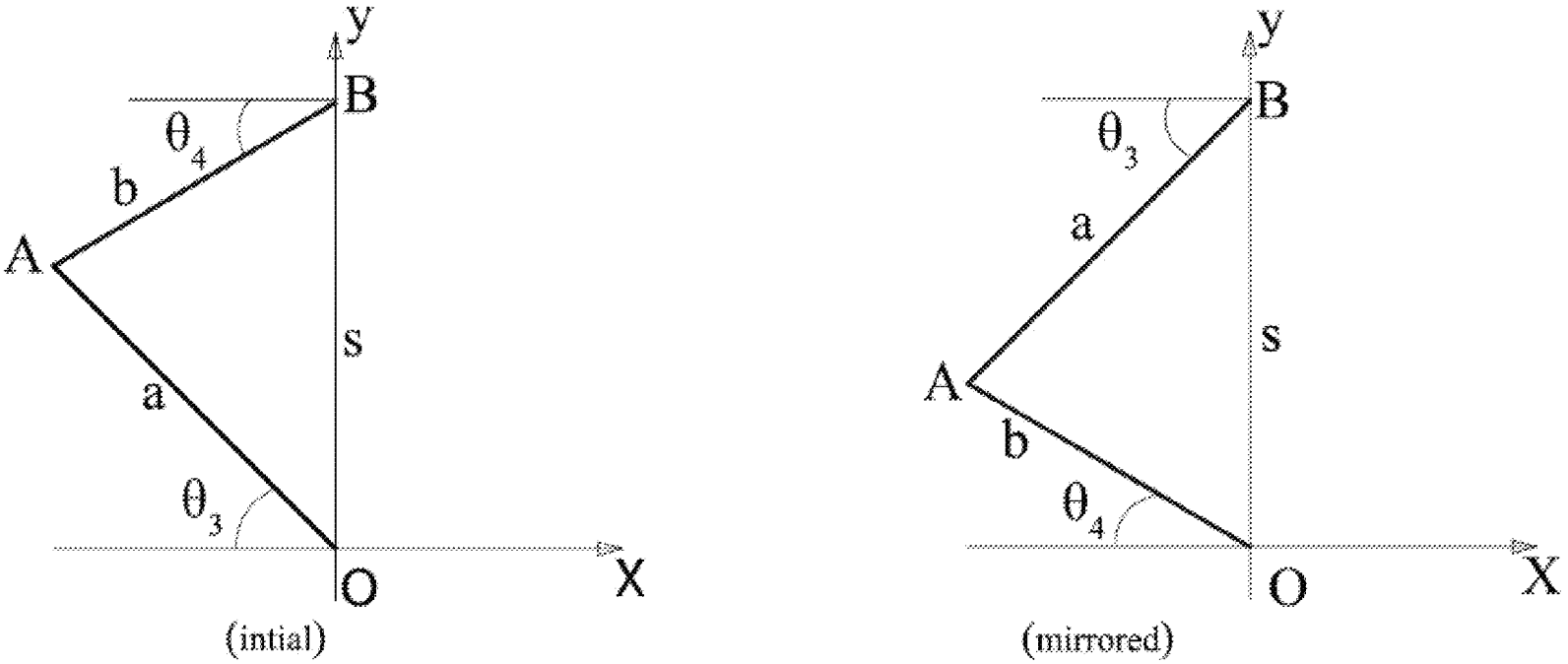
FIG. 6 shows the original and mirrored angles of the mechanism based adjustable connection of FIG. 4.

In the vertical configuration shown in FIG. 4, the rigid links of the RRRP linkage connect points O, A, and B. The slider represents the location of point B along the vertical member 14. As point B is translated along the vertical member 14, the connection angle between the horizontal member 16 and the vertical member 14 ($\theta_3$) changes. If it is mirrored, a second set of angles is possible: $\theta_4$ as shown in FIG. 6.

The system is defined by the ratio of the lengths of the links ($\alpha$):

$$\alpha = \frac{a}{b} \qquad \text{eq. (1)}$$

and the angle $\theta_3$. It is required in this example that $0<\theta_3<90°$. $\theta_4$ is related to $\theta_3$ by:

$$\theta_4=\arccos(\alpha \cos \theta_3) \qquad \text{eq. (2)}$$

The slider length (s) (i.e., the distance between O and B) can be determined by:

$$s=a \sin \theta_3 \pm\sqrt{a^2\sin^2\theta_3-a^2+b^2} \qquad \text{eq. (3)}$$

There are therefore two possibilities for slider length (s). Following the above, if $\theta_4$ is restricted to $0<\theta_4<90°$, only:

$$s=a \sin \theta_3+\sqrt{a^2\sin^2\theta_3-a^2+b^2} \qquad \text{eq. (4)}$$

is possible. For slider length (s) to be real, the following must also be satisfied:

$$\alpha < \frac{1}{\cos(\theta_3)} \qquad \text{eq. (5)}$$

Therefore, for each $\theta_3$, there is a corresponding maximum value for $\alpha$:$\alpha_{max}$. For the range of $30°\leq\theta_3<70°$ considered here, $\alpha_{max}$=1.1547.

Using typical desirable angles ($30°\geq\theta_3<70°$), $\alpha$ is selected such that the $\theta_4$ values are as different as possible from $\theta_3$. This would enable a single configuration to result in a large number of different angles. In this case, five discretized angles are considered for $\theta_3$:$\theta_3$=30°, 40°, 50°, 60°, 70°. FIG. 7 shows a chart variations of $\theta_4$ for these values of $\theta_3$ given different values of $\alpha$.

To further investigate this, a study was performed which varies $\alpha$ from 0 to 1.15 in increments of 0.00001. As a metric to determine the difference between each $\theta_3$ and $\theta_4$ for a given $\alpha$, the following value is computed:

$$A = ave\begin{Bmatrix} \min[\text{abs}(\theta_4 - 30); \forall\, \theta_4] \\ \min[\text{abs}(\theta_4 - 40); \forall\, \theta_4] \\ \min[\text{abs}(\theta_4 - 50); \forall\, \theta_4] \\ \min[\text{abs}(\theta_4 - 60); \forall\, \theta_4] \\ \min[\text{abs}(\theta_4 - 70); \forall\, \theta_4] \end{Bmatrix} \qquad \text{eq. (6)}$$

Figure 8:
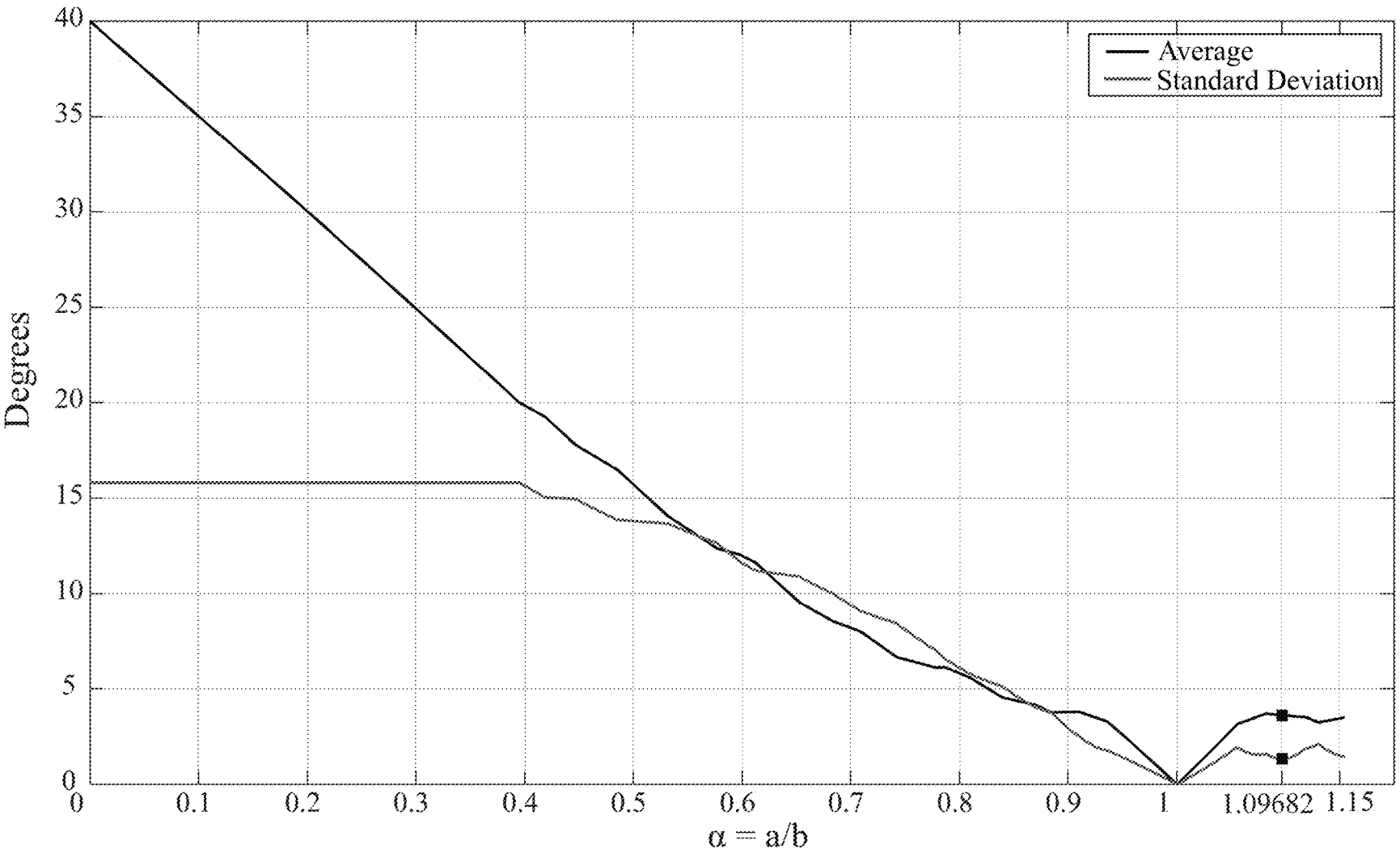
FIG. 8 is a graph showing the relation of $\alpha$, $\theta_3$, and $\theta_4$.
Figure 9A:
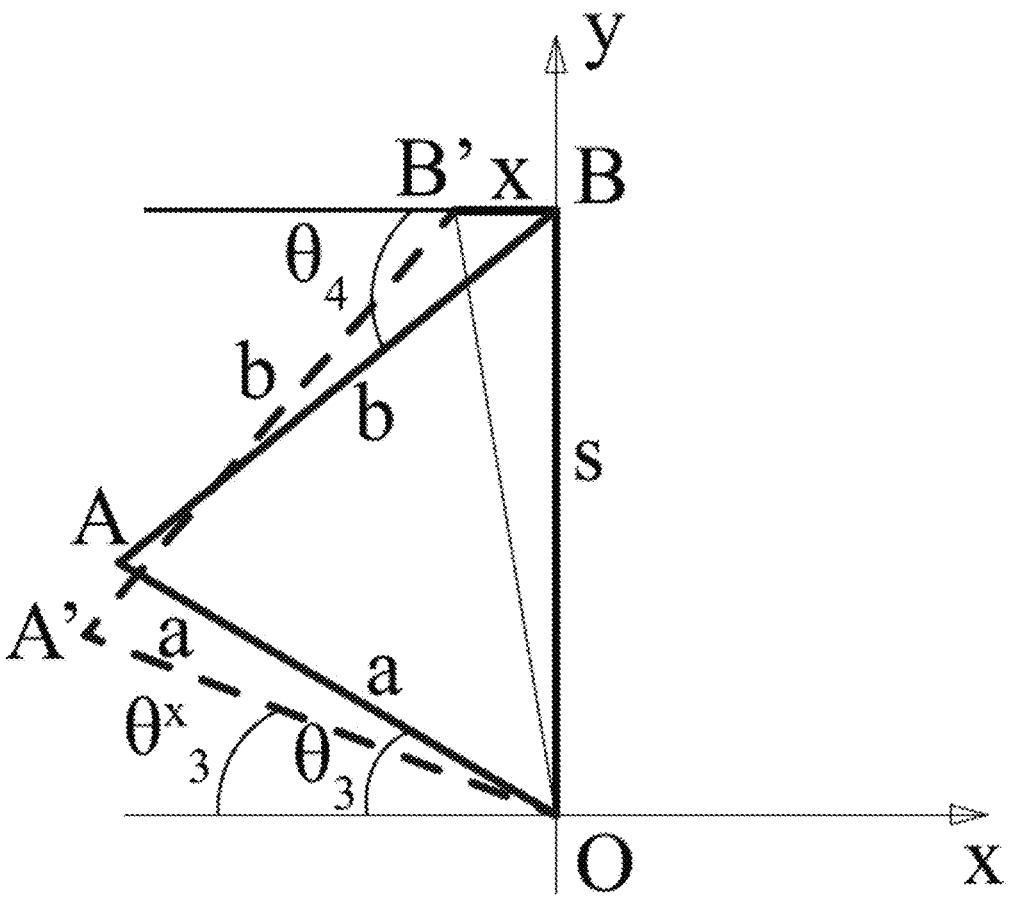
FIG. 9A is a depiction of the location of Point B of FIG. 4 in a leftward configuration at its initial angle.
Figure 9B:
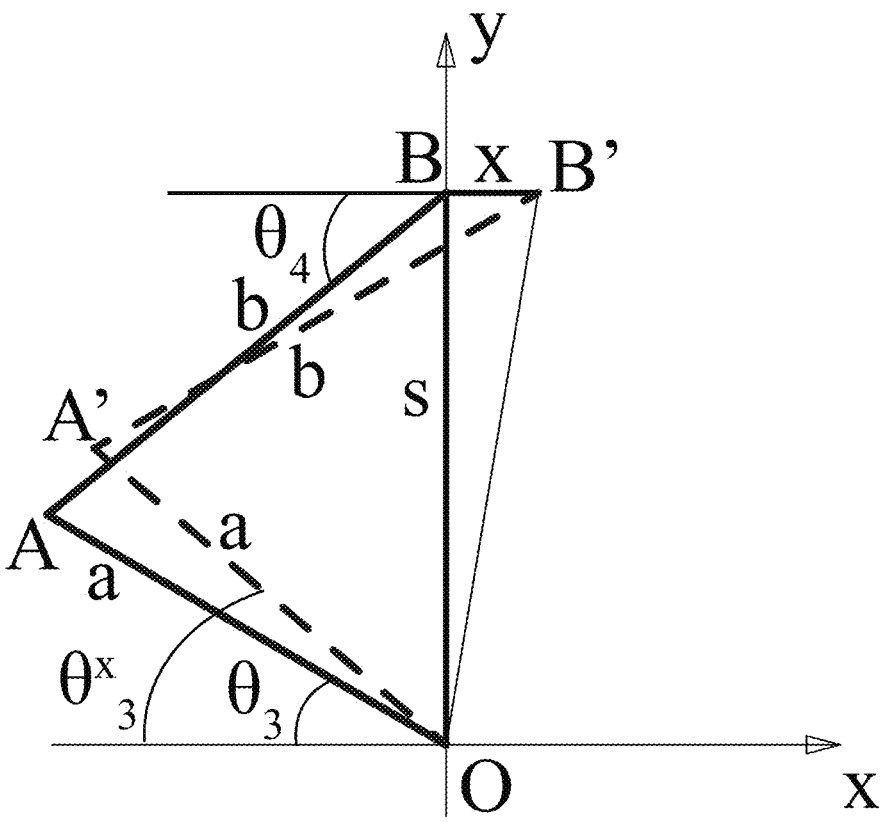
FIG. 9B is a depiction of the location of Point B of FIG. 4 in a leftward configuration at its initial angle.
Figure 9C:
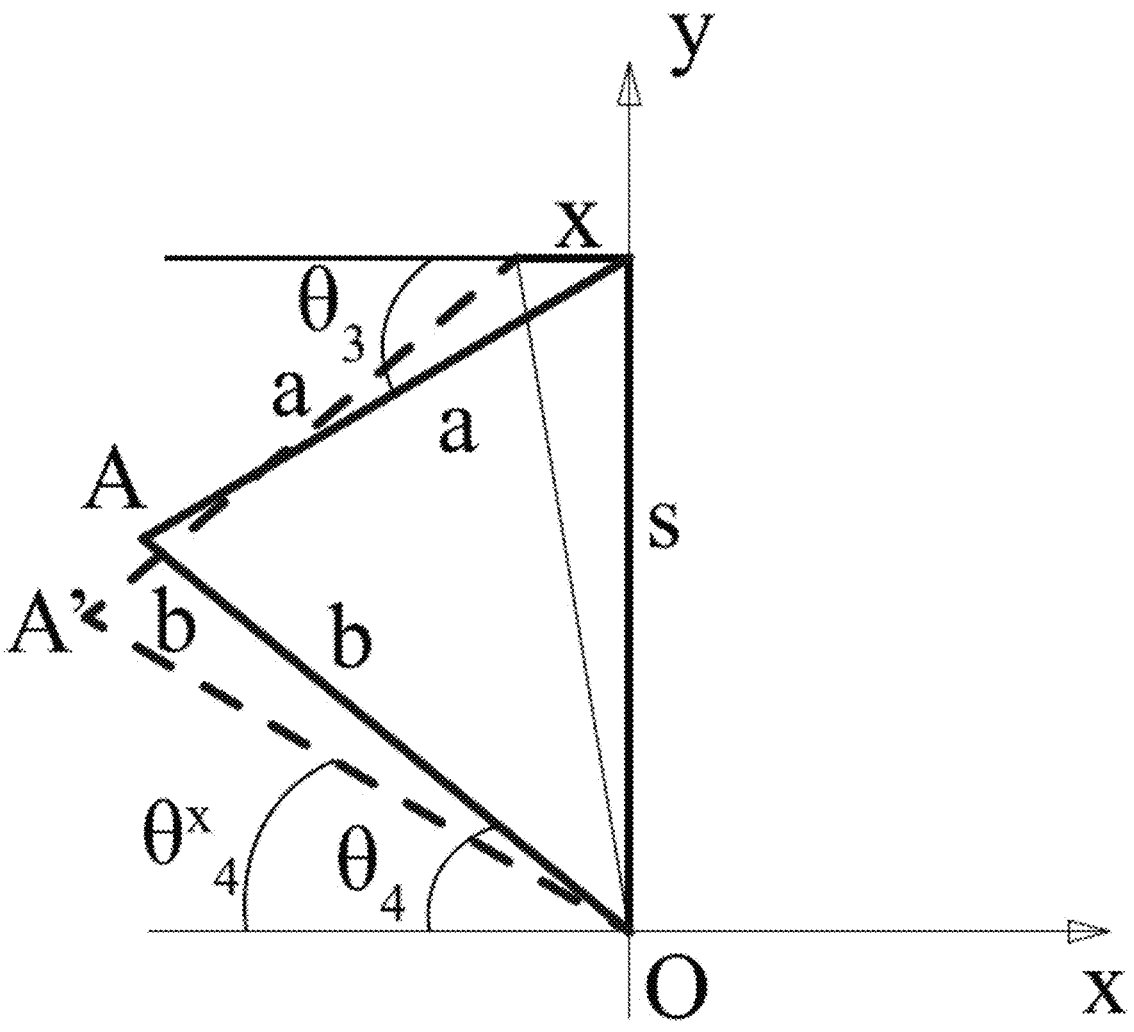
FIG. 9C is a depiction of the location of Point B of FIG. 4 in a leftward configuration at its mirrored angle.
Figure 9D:
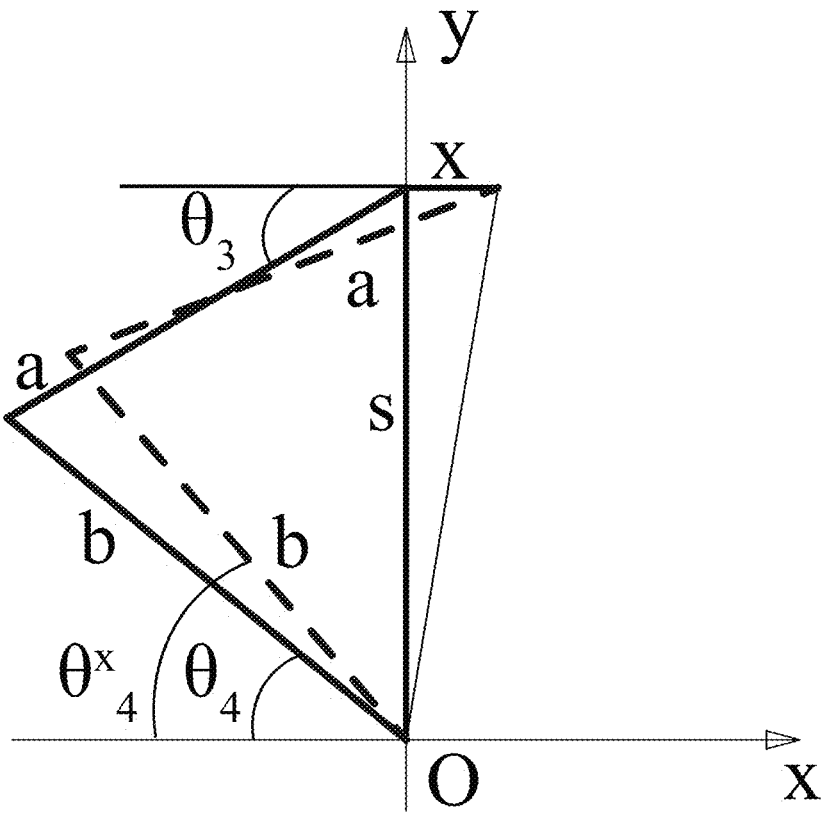
FIG. 9D is a depiction of the location of Point B of FIG. 4 in a rightward configuration at its mirrored angle.
Figure 10:
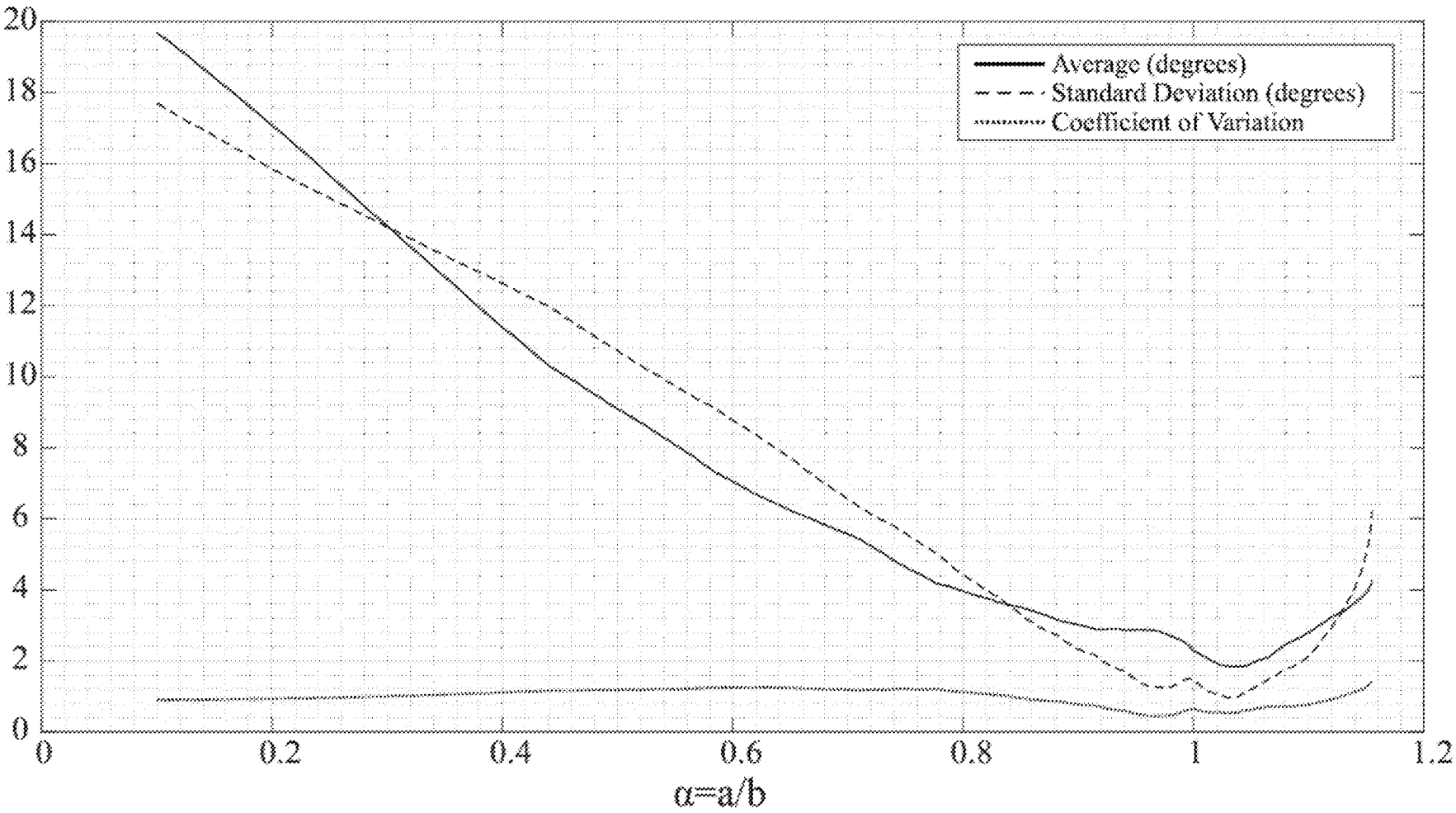
FIG. 10 is a graph showing the value of A while varying $\alpha$, with x=0.2 and s=5.
Figure 11:
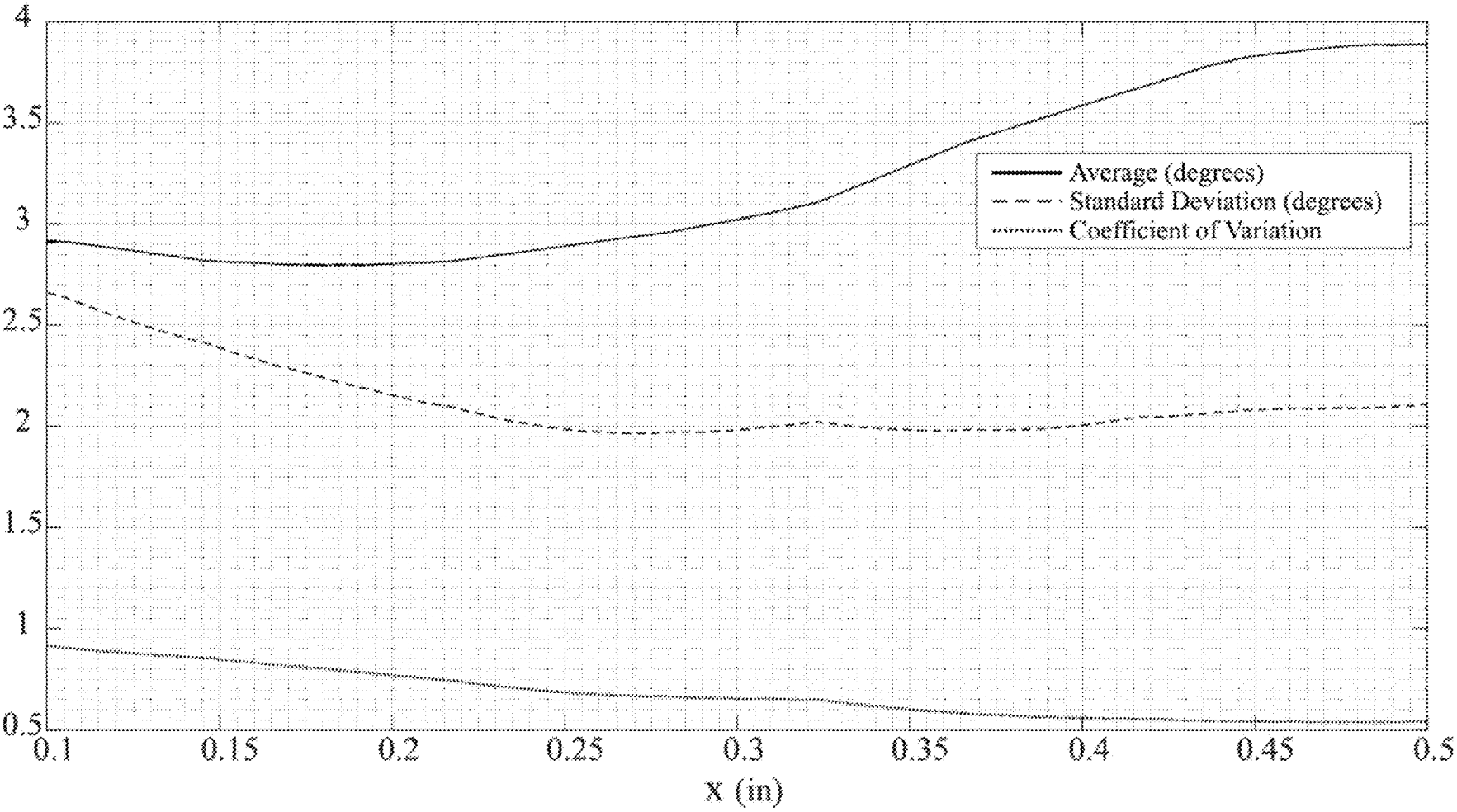
FIG. 11 is a graph showing the value of A while varying x, with $\alpha$=1.1 and s=5.
Figure 12:
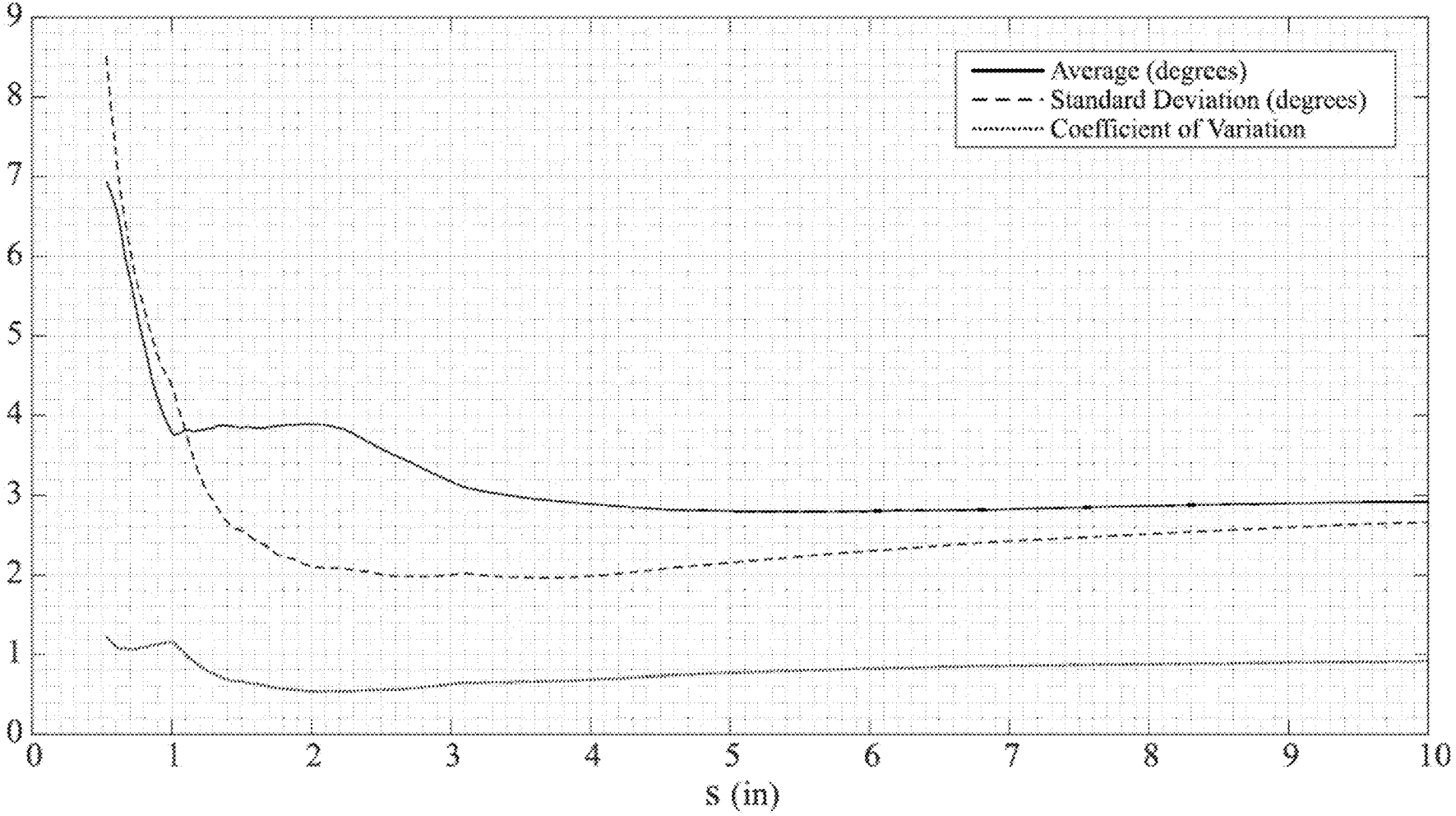
FIG. 12 is a graph showing the value of A while varying s, with $\alpha$=1.1 and x=0.2.

This metric is shown in FIG. 8. The standard deviation is also shown. It is desirable to have a high value of the metric A, indicating that there is a greater difference between each $\theta_3$ and $\theta_4$. It is also desirable to have a low standard deviation of this metric. The value for $\alpha$ which features a value for A and a low standard deviation is: $\alpha$=1.09682.

As shown in FIGS. 9A-D, if point B is also allowed to translate horizontally, additional connection angles are possible. In FIGS. 4, 6-9, the slider point B was considered to be on the centerline of the vertical member. In this study, point B is moved perpendicular to the center line (y-axis), either on the left or right side by a distance x, so that the slide position s remains the same, as shown in FIGS. 9A-D. This new configuration of the linkage gives another set of angles: $\theta_3^x$. If this configuration is then mirrored, another set of angles is possible: $\theta_4^x$.

When the pivot point B is moved left of the y-axis, the angle $\theta_3^x$ is given by:

$$\theta_3^x = 90 - \arccos\frac{a^2 + x^2 + s^2 - b^2}{2a\sqrt{x^2 + s^2}} - \arccos\frac{s}{\sqrt{x^2 + s^2}} \qquad \text{eq. (7)}$$

And the mirrored angle $\theta_4^x$ is computed:

$$\theta_4^x = 90 - \arccos\frac{b^2 + x^2 + s^2 - a^2}{2b\sqrt{x^2 + s^2}} - \arccos\frac{s}{\sqrt{x^2 + s^2}} \qquad \text{eq. (8)}$$

When the pivot point B is moved right to the y-axis, the angle $\theta_3^x$ is given by:

$$\theta_3^x = 90 + \arccos\frac{s}{\sqrt{x^2+s^2}} - \arccos\frac{a^2+x^2+s^2-b^2}{2a\sqrt{x^2+s^2}} \quad \text{eq. (9)}$$

And the mirrored angle $\theta_4^x$ is computed:

$$\theta_4^x = 90 - \arccos\frac{s}{\sqrt{x^2+s^2}} - \arccos\frac{b^2+x^2+s^2-a^2}{2b\sqrt{x^2+s^2}} \quad \text{eq. (10)}$$

Another parametric study was performed to investigate the parameters: slide position s, ratio $\alpha$=a/b, and x. The objective was to select parameters for which the values of $\theta_3$, $\theta_4$, $\theta_3^x$, and $\theta_4^x$ differ from each other to obtain a wide range of angles. As a metric to determine the difference between each $\theta_3$, $\theta_4$, $\theta_3^x$, and $\theta_4^x$, the following value is computed:

$$A_2 = ave\begin{Bmatrix} \min[\text{abs}(\theta_4-\theta_3)] \\ \min[\text{abs}(\theta_3^x-\theta_3)] \\ \min[\text{abs}(\theta_4^x-\theta_3)] \\ \min[\text{abs}(\theta_4-\theta_4^x)] \\ \min[\text{abs}(\theta_4^x-\theta_3^x)] \end{Bmatrix} \quad \text{eq. (11)}$$

To compute this metric, the following relations are computed. The length of each link can be computed by:

$$a = \frac{s}{\sin\theta_3 + \sqrt{\left(\frac{1}{\alpha}\right)^2 - \cos^2\theta_3}} \quad \text{eq. (12)}$$

$$b = \frac{a}{\alpha} \quad \text{eq. (13)}$$

For $\theta_3^x$, $\theta_4^x$ to exist, the triangle OA'B' must exist, for which the following must be satisfied:

$$s \geq \frac{x}{\sqrt{\left(1+\frac{1}{\alpha}\right)^2\left(\frac{1}{\sin\theta_1 + \sqrt{\left(\frac{1}{\alpha}\right)^2 - \cos^2\theta_1}}\right)^2 - 1}} \quad \text{eq. (14)}$$

The following possible ranges of values for the parameters are considered:

$\theta_3$=30°; 40°; 50°; 60°; 70°;

$0.1 \leq \alpha \leq \alpha_{max}$, where $$\alpha_{max} = \frac{1}{\cos\theta_3}$$

$0.1 \leq x \leq 0.5$;

$s_{min} \leq s \leq 10$;

where $s_{min}$ is given by Equation 14. Some of the results of this study are charted in FIGS. 10, 11, and 12. It would be desirable to select parameters for which the metric $A_2$ is high and the standard deviation is low.

FIGS. 13-17 demonstrate how the adjustable connections could be used to form panelized bridges where the angle of the diagonal can be θ=30°, 40°, 50°, or 60°, measured with respect to the horizontal. These angles could be achieved using the example adjustable connection 10 or example adjustable connection 10'. Varying the angle of the diagonal changes the amount of force in the diagonal. It can be advantageous to keep the force in the diagonals similar throughout the structure as the same section could then be used throughout. The following details one method to arrive at forms for panelized bridges using diagonals with angles of θ=30°, 40°, 50°, or 60°, measured with respect to the horizontal. Other methods for determining geometries of panelized bridges using the adjustable connection are also possible.

Figure 13:
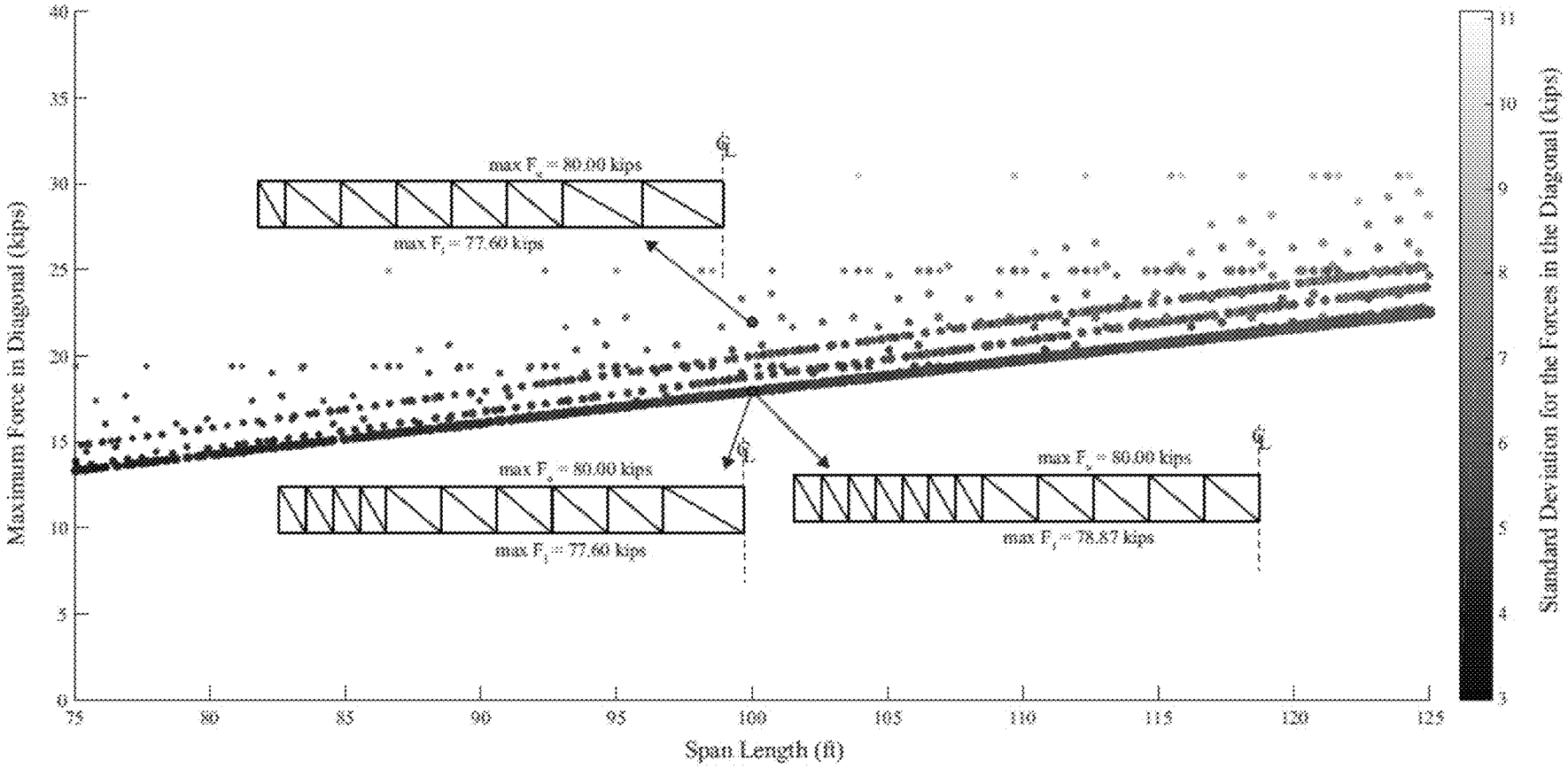
FIG. 13 is a graph showing the maximum force in diagonal members for example panelized bridges using 30°, 40°, 50°, and/or 60° angles, approximately 100 ft in span.
Figure 14:
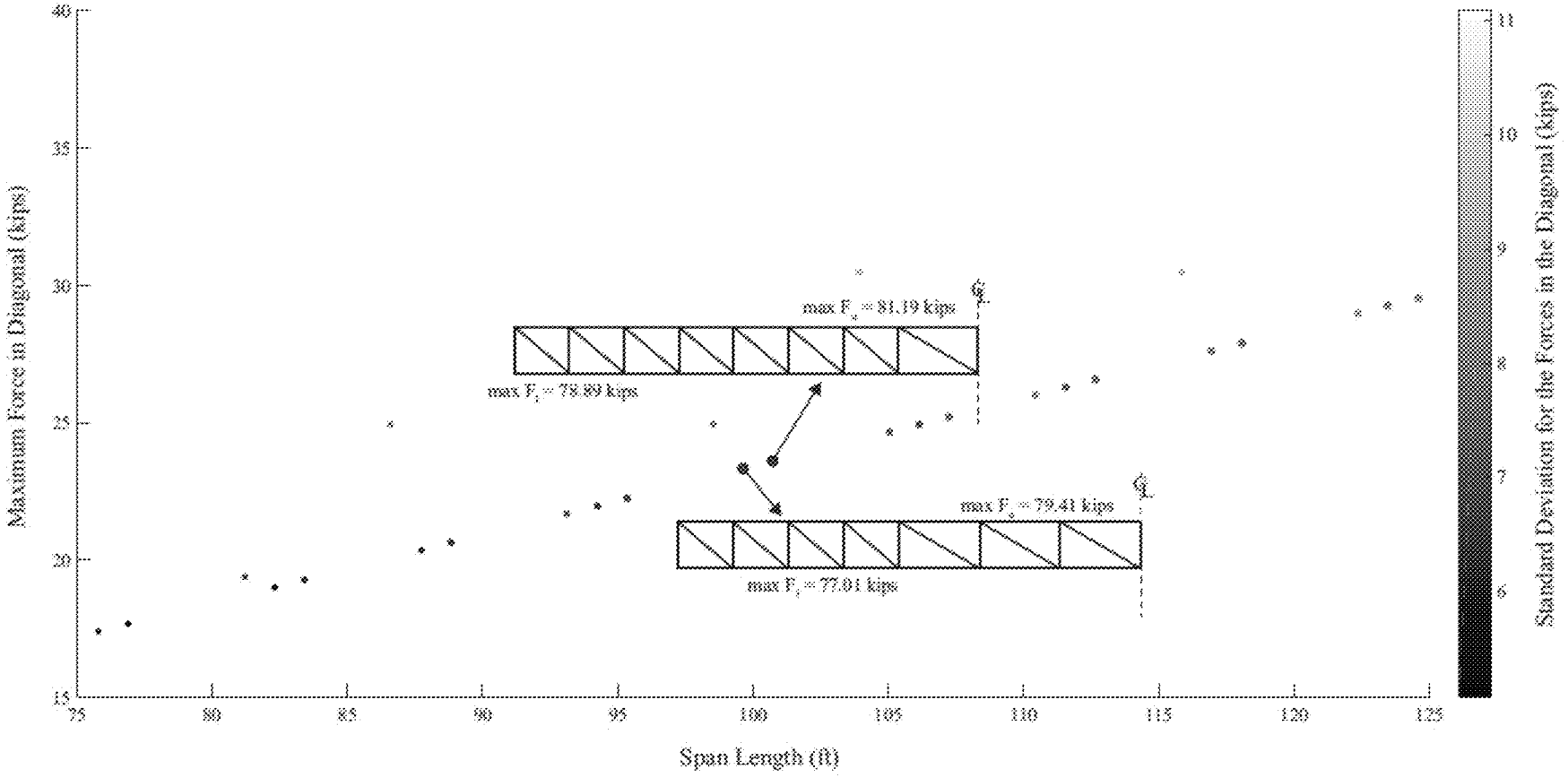
FIG. 14 is a graph showing the maximum force in diagonal members for example panelized bridges using 30° and/or 40° angles, approximately 100 ft in span.
Figure 15:
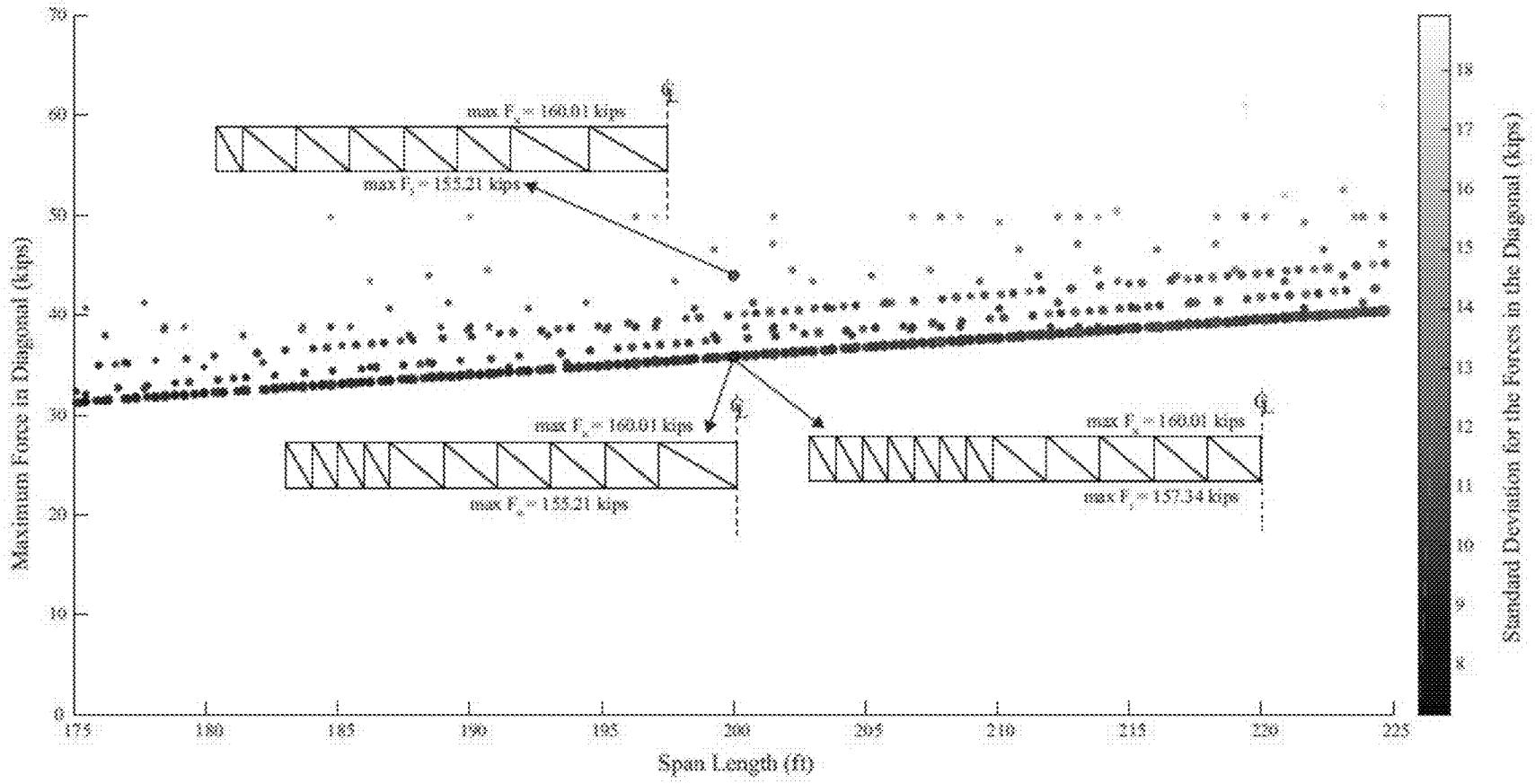
FIG. 15 is a graph showing the maximum force in diagonal members for example panelized bridges using 30°, 40°, 50°, and/or 60° angles, approximately 200 ft in span.
Figure 16:
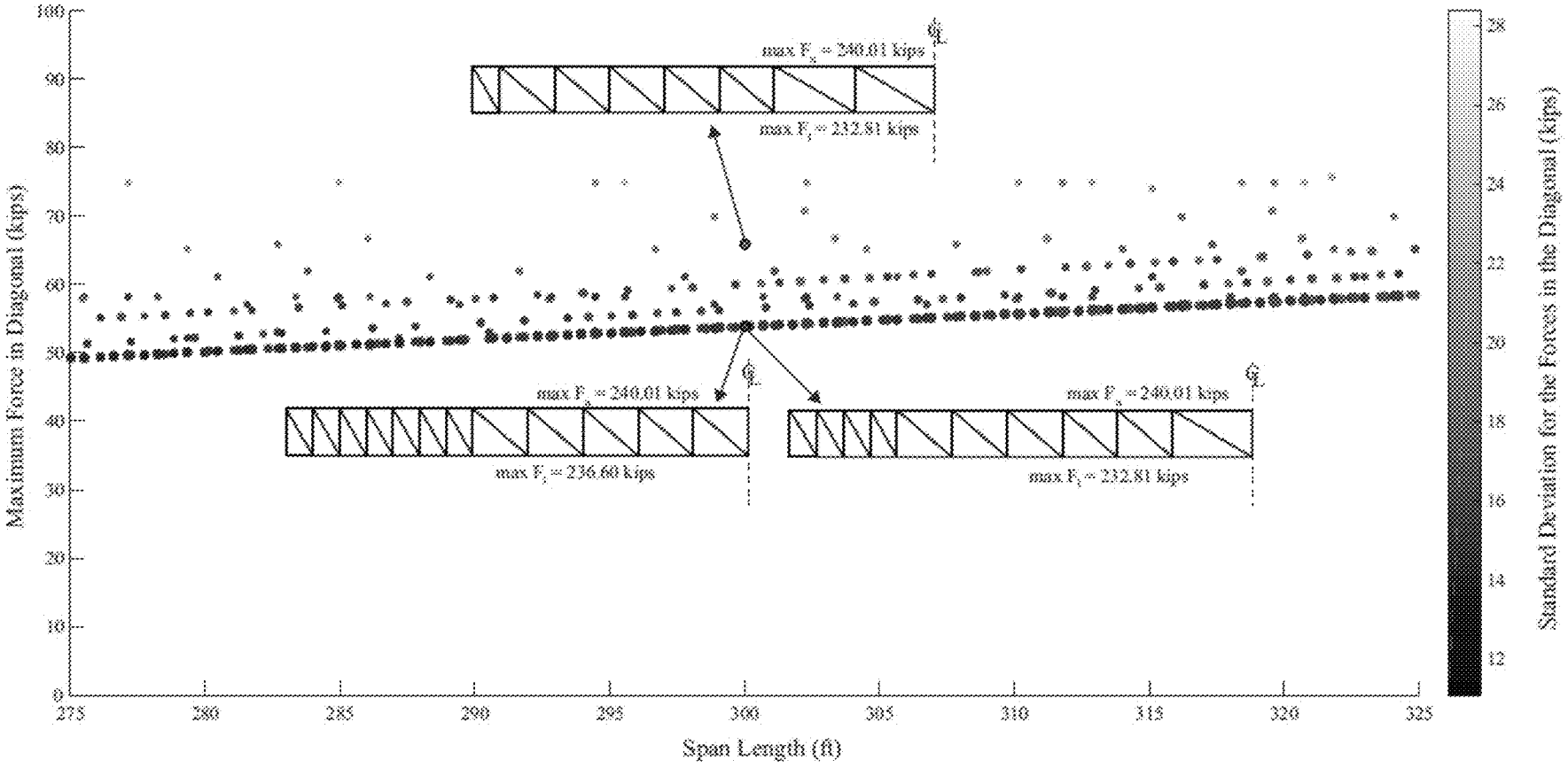
FIG. 16 is a graph showing the maximum force in diagonal members for example panelized bridges using 30°, 40°, 50°, and/or 60° angles, approximately 300 ft in span.
Figure 17A:
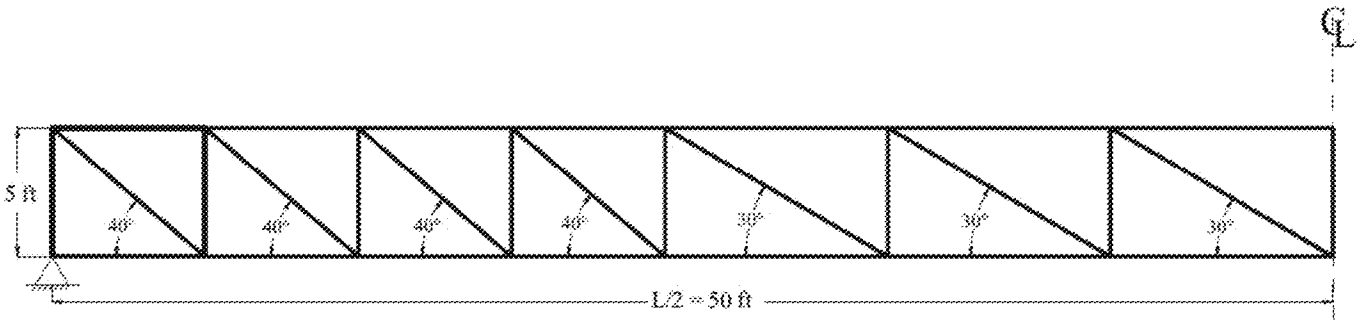
FIG. 17A is an elevation of an example simply supported panelized bridge, approximately L=100 ft in span, showing only half of the bridge with symmetry assumed. A pin restraint is shown. A roller restraint would be on the other end.
Figure 17B:
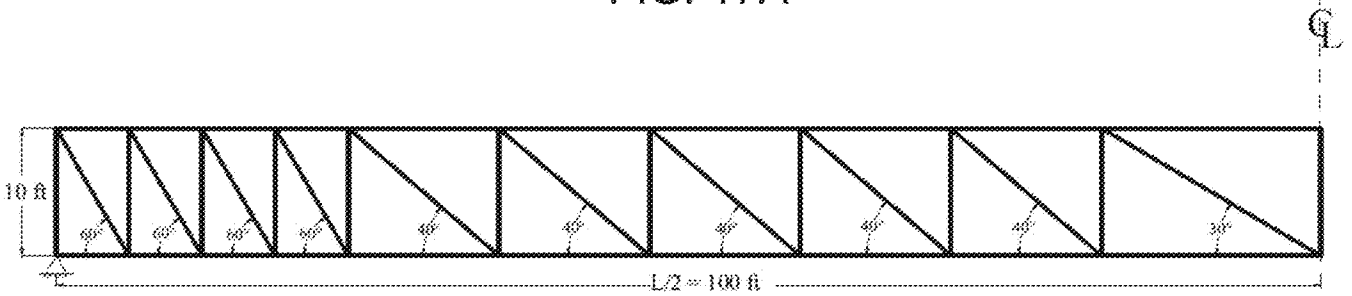
FIG. 17B is an elevation of an example simply supported panelized bridge, approximately L=200 ft in span, showing only half of the bridge with symmetry assumed. A pin restraint is shown. A roller restraint would be on the other end.
Figure 17C:
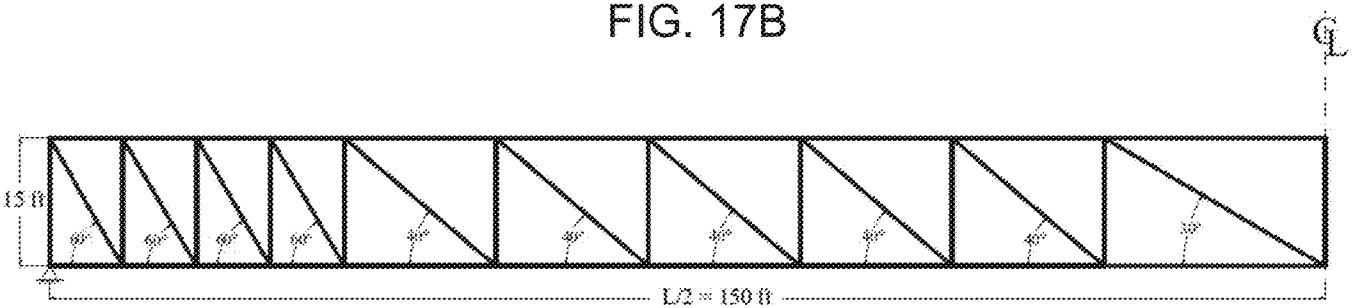
FIG. 17C is an elevation of an example simply supported panelized bridge, approximately L=300 ft in span, showing only half of the bridge with symmetry assumed. A pin restraint is shown. A roller restraint would be on the other end.

Parametric studies were performed to select potential geometries of simply supported panelized bridges for which the forces in the diagonals are as similar as possible. Span lengths of 100, 200, and 300 ft with span to depth ratios of 20 were considered. More specifically, for 100 ft span, the depth is 5 ft. For the 200 ft span, the depth is 10 ft. For the 300 ft span, the depth is 15 ft. However, other span lengths and span to depth ratios are also possible. Diagonals were considered at angles of θ=30°, 40°, 50°, or 60°, measured with respect to the horizontal. Every possible permutation of this angle θ was considered for each diagonal in each span length. For each permutation, the method of joints was used to calculate the force in each diagonal under a uniformly distributed vehicular lane load of 0.64 kip/ft, as given by bridge design code. FIGS. 13-16 graph the maximum force in any diagonal and the standard deviation for different span lengths. Selected options are drawn (shown as only half the span). Symmetry is assumed. FIG. 13 shows all of the options for approximately 100 ft span. Note that the actual span length varies from 100 ft to achieve an integer number of panels. FIG. 14 shows the options for approximately 100 ft span, with the angle restricted to just θ=30° or 40°. This was considered since the panel lengths become short for the higher angles. FIG. 15 shows the options for approximately 200 ft span. FIG. 16 shows the options for approximately 300 ft span. Note that for FIGS. 13, 15, and 16, the first angle (the one nearest the support) was required to be θ=60° as the shear force is the highest near the support in this example. FIG. 17A-C shows elevation views of panelized bridges selected based on this parametric study, for the 100 ft, 200 ft, and 300 ft span, respectively.

Figure 18:
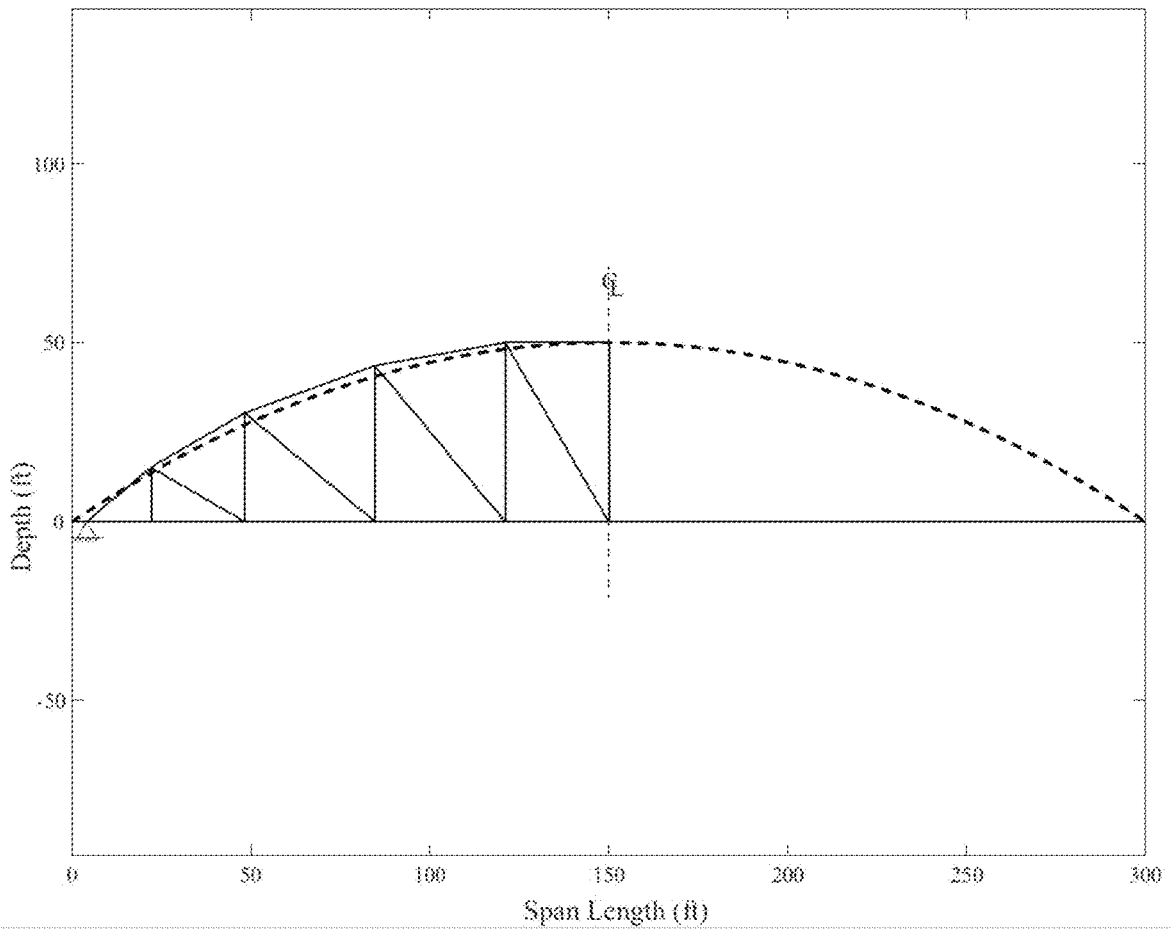
FIG. 18 is an example simply supported variable depth truss bridge (solid line), approximately L=300 ft in span. Only half of the bridge is shown, with symmetry assumed. A pin restraint is shown. A roller restraint would be on the other end. Dashed line indicates shape of moment diagram for simply supported truss under a uniform load.

FIG. 18 shows an example simply supported variable depth truss bridge for an approximate 300 ft span. While this form features vertical members, the variable depth truss could also be achieved using a different topology (e.g., warren type truss) The variable depth form was selected based on the scaled moment diagram (dashed line; scaled to achieve a depth at midspan of 50 ft) for a simply supported beam under a uniform load (i.e., 0.64 kip/ft distributed vehicular lane load as given by bridge design code). The geometry of the truss (solid line) was scribed to approximate this shape. It was also required that each member not be longer than 60 ft. All angles between members are required to be θ=30°, 40°, 50°, 60°, 70°, 80°, or 90°. This form could be achieved using the example adjustable connection 10 or example adjustable connection 10', if the set of possible angles of the example adjustable connection 10 or example adjustable connection 10' is expanded. This represents the ability for the adjustability connection to form variable depth simply supported truss bridges. Other forms are also possible. Other methods for determining the geometry of the form are also possible.

Figure 19:
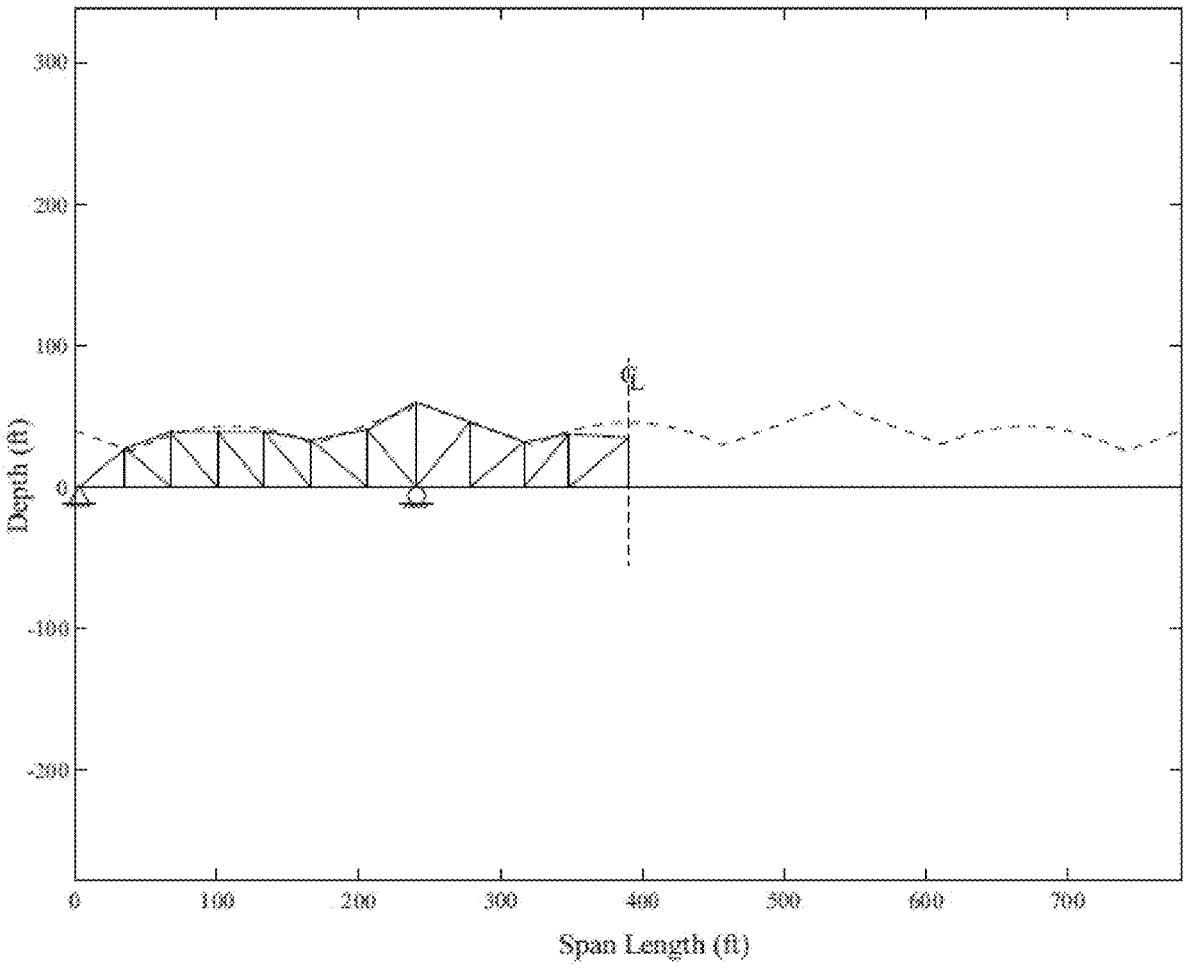
FIG. 19 is an example three-span continuous variable depth truss bridge (solid line). Only half of the bridge is shown, with symmetry assumed. A pin and a roller restraint are shown. Additional roller restraints would be on the other end. Dashed line indicates shape of the envelope of the moment and shear diagrams for the continuous truss under multiple load cases.

FIG. 19 shows an example three-span continuous variable depth truss bridge for an approximate 800 ft total span. In this example, the middle span is approximately 300 ft and the side spans are approximately 80% of this length. The variable depth form was selected based on the moment and shear diagrams for a three-span continuous beam under a number of load cases. These load cases include a uniform load (i.e., 0.64 kip/ft distributed vehicular lane load as given by bridge design code) over (1) the whole bridge, (2) half of the bridge, (3) only one side span, (4) only the middle span, (5) one side span and the middle span, and (6) the two side spans. The moment and shear diagrams were calculated for each load case. The highest value for the moment and the highest value of the shear over all load cases were then found. Each was then scaled to achieve a depth at the inner support of 60 ft. The higher value of both was then taken as the desired form (dashed line). The geometry of the truss (solid line) was scribed to approximate this shape. For feasibility, it was also required that each member not be longer than 60 ft and that each panel length must be at least 30 ft. All angles between members are required to be even increments of 10° to be achievable with the example adjustable connection 10 or the example adjustable connection 10' (with an expanded set of possible angles). An exception is at midspan when other angles are allowed. Other forms are also possible as would be understood by one of ordinary skill in the art. Other methods for determining the geometry of the form are also possible.

Another embodiment of this disclosure is shown in FIG. 20. As depicted in FIGS. 20A-D, it is contemplated that an example adjustable connection 10" can be used for joining rapidly erectable bridge modules. To demonstrate the potential for adjustable connections 10" to increase the efficiency of a rapidly erectable bridging system, an investigation was performed for a 100 ft span comprised of Bailey panels (FIG. 20B-C). As will be appreciated, the structural members could be truss elements in the panel sections.

Figure 20A:
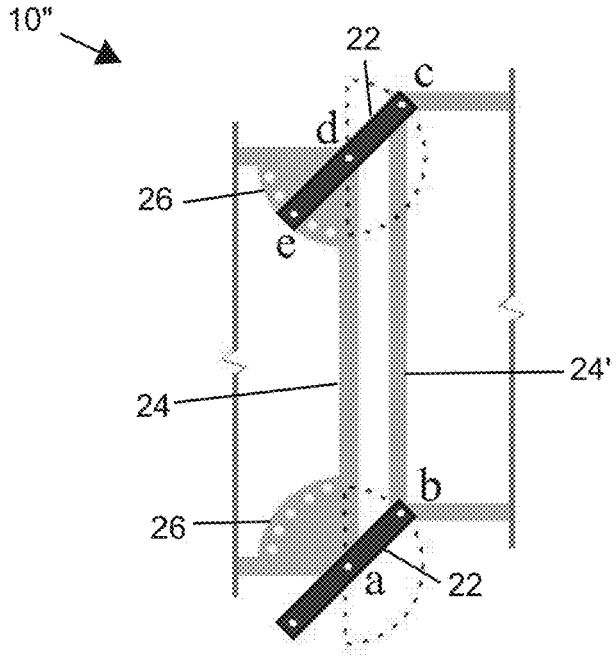
FIG. 20A is an example articulated linkage in a configuration that would be amenable to the adjustable connection of the present disclosure.

A preliminary concept for an adjustable connection 10" features a four-bar (4R) linkage (connecting abcd), as shown in FIG. 20A, which permits a change in vertical alignment between panels. The linkage is comprised of two sides of panels, vertical members 24, 24', and short link elements 22 (scale exaggerated), connected to gusset plates 26. The 4R mechanism can be moved until the desired change in vertical alignment is achieved. Once the desired position is found, the linkage is fixed by bolting one of the links in its corresponding curved gusset plate 32 which features a series of bolt holes (point "e" in FIG. 20A).

Figure 20B:
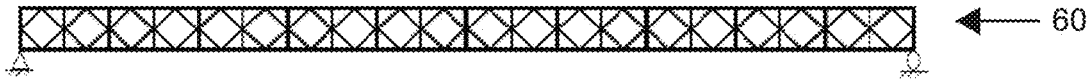
FIG. 20B is a depiction of the configuration of rapidly erectable bridge modules.
Figure 20C:
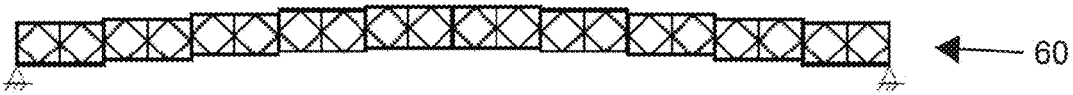
FIG. 20C is a depiction of another configuration of rapidly erectable bridge modules.
Figure 20D:
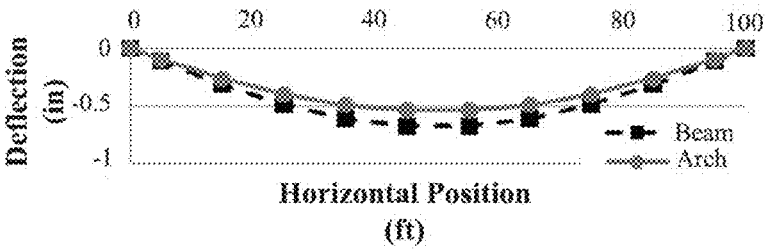
FIG. 20D is a graph showing the deflection of the systems shown in FIGS. 20B and 20C.

This change in vertical alignment would permit alternate configurations compared to the standard simply supported beam configuration of the Bailey System (panels are connected by pins at the upper and lower chords, FIG. 20B). One example of an alternate configuration is the arch 60 shown in FIG. 20C (panels are offset vertically by one half foot per panel for an arch depth of 2 ft over the 100 ft span). To demonstrate the effect of this difference in form, finite element analyses were performed for both configurations. Bailey panels were modeled as one-dimensional beam elements with approximated section properties. In some embodiments, the chords are 2, 4 in deep channels, assumed to be C4×7.25. A representative uniform load was applied to represent the panel self-weight. Deflections of the arch (FIG. 20C) with adjustable connections were 15-20% less than the standard configuration (FIG. 20B), as shown in FIG. 20D. While it is no surprise to one of ordinary skill in the art that an arch has lower deflections than a simply supported beam, this preliminary study indicates the potential for increased efficiency through adjustable connections.

Although certain example methods and apparatus have been described herein, the scope of coverage of this patent is not limited thereto. On the contrary, this patent covers all methods, apparatus, and articles of manufacture fairly falling within the scope of the appended claims either literally or under the doctrine of equivalents.

We claim:

1. An adjustable connection for joining structural members comprising:

a first structural member and a second structural member to be positioned at a desired angle relative to the first structural member;

a universal gusset plate adapted to join the first structural member and the second structural member at a plurality of angles; connected to the first structural member and the second structural member at the desired angle;

a first curved plate with a first end section and a second end section connected by a curved central section such that the first end section is connected to the first structural member at a portion that is substantially parallel and the second end section is connected to the second structural member at a portion that is substantially parallel, wherein the curved central portion is curved at an angle such that the second structural member is positioned at the desired angle relative to the first structural member.

2. The adjustable connection of claim 1, further comprising a third structural member connected to the universal gusset plate at a second desired angle; and at least one additional curved plate with a first end section and a second end section connected by a curved central section such that the first end section is connected to the second structural member at a portion that is substantially parallel and the second end section is connected to the third structural member at a portion that is substantially parallel;

wherein the curved central portion is curved at an angle such that the second structural member is positioned at the second desired angle relative to the third structural member.

3. The adjustable connection of claim 1, wherein the desired angle is between 30° and 70°.

4. The adjustable connection of claim 2, wherein the at least one of the first structural member, second structural member, or third structural member is connected to the universal gusset plate by bolts.

5. The adjustable connection of claim 1, further comprising plates positioned between the second structural member and the gusset plate operable to facilitate the connection.

6. The adjustable connection of claim 2, further comprising plates positioned between the second or third structural member and the gusset plate operable to facilitate the connection.

7. The adjustable connection of claim 2, wherein at least one of the first structural member, the second structural member, the third structural member, and first curved plate are steel.

8. The adjustable connection of claim 7, wherein the first curved plate is cold bent.

9. The adjustable connection of claim 8, wherein the first curved plate is adapted to be cold bent on site or with press brake.

10. The adjustable connection of claim 2, wherein at least one of the first structural member, the second structural member, the third structural member are one of wide flange or double channel sections.

* * * * *